US010152921B2

(12) United States Patent
Hikichi et al.

(10) Patent No.: US 10,152,921 B2
(45) Date of Patent: Dec. 11, 2018

(54) DRIVE CIRCUITRY CONFIGURATION IN DISPLAY DRIVER

(71) Applicant: Synaptics Japan GK, Tokyo (JP)

(72) Inventors: Toshiyuki Hikichi, Tokyo (JP); Shinobu Nohtomi, Tokyo (JP)

(73) Assignee: Synaptics Japan GK, Tokyo (JP)

( * ) Notice: Subject to any disclaimer, the term of this patent is extended or adjusted under 35 U.S.C. 154(b) by 0 days.

(21) Appl. No.: 15/456,181

(22) Filed: Mar. 10, 2017

(65) Prior Publication Data

US 2017/0270865 A1 Sep. 21, 2017

(30) Foreign Application Priority Data

Mar. 15, 2016 (JP) ..... 2016-051313

(51) Int. Cl.

| | |
|---|---|
| ***G09G 3/32*** | (2016.01) |
| ***G09G 3/36*** | (2006.01) |
| ***G09G 3/3258*** | (2016.01) |

(52) U.S. Cl.

CPC ..... *G09G 3/3258* (2013.01); *G09G 3/3648* (2013.01); *G09G 2310/08* (2013.01); *G09G 2320/0626* (2013.01); *G09G 2320/0666* (2013.01)

(58) Field of Classification Search

CPC ..... G09G 3/3258; G09G 3/3648; G09G 2310/08; G09G 2320/0626; G09G 2320/0666; G09G 2310/0291; H03F 3/45–3/45928

See application file for complete search history.

(56) References Cited

U.S. PATENT DOCUMENTS

| | | | | |
|---|---|---|---|---|
| 8,988,402 | B2 * | 3/2015 | Tsuchi | H03F 1/0261 330/253 |
| 9,892,703 | B2 * | 2/2018 | Tsuchi | G09G 3/3677 |
| 2006/0125759 | A1 * | 6/2006 | An | G09G 3/3688 345/98 |
| 2009/0231319 | A1 * | 9/2009 | Tsuchi | G09G 3/3688 345/211 |
| 2015/0310822 | A1 | 10/2015 | Saeki | |

* cited by examiner

*Primary Examiner* — Stephen G Sherman

(74) *Attorney, Agent, or Firm* — Patterson + Sheridan, LLP

(57) ABSTRACT a display driver is provided which drives a display panel. The display driver includes first and second buffer amplifiers associated with first and second pixels positioned adjacent in a horizontal direction; first and second connection switches; and a controller. Each of the first and second buffer amplifiers includes: a differential input circuit including a MOS transistor pair, first and second drain interconnections; an active load circuit connected to the first and second drain interconnections; and an output stage. The first connection switch is connected between the output nodes of the first and second buffer amplifiers. The second connection switch is connected between the first drain interconnections of the first and second buffer amplifiers. The controller controls the first and second switches in response to image data associated with the first and second pixels.

20 Claims, 17 Drawing Sheets

DRIVE CIRCUITRY CONFIGURATION IN DISPLAY DRIVER

CROSS REFERENCE

This application claims priority of Japanese Patent Application No. 2016-051313, filed on Mar. 15, 2016, the disclosure of which is incorporated herein by reference.

TECHNICAL FIELD

The present disclosure relates to a display driver and display device, more particularly to the configuration of a drive circuitry that drives source lines of a display panel in response to image data.

BACKGROUND ART

Recent display devices are often required to achieve a high precision of voltages supplied to source lines (also referred to as signal lines or data lines) of display panels; the voltages supplied to the source lines may be simply referred to as "source voltages", hereinafter. For example, in a display device incorporating an OLED (organic light emitting diode) display panel, which exhibits a larger change in the brightness against the source voltage, it is preferable to generate the source voltages with a higher precision in view of improvement in the display image quality.

The issue of the precision of the source voltages is especially significant in displaying an image including a region of a single color. When an image including a region of a single color is displayed, the same image data are supplied for the pixels in the region, where an image data indicates the grayscale levels of the respective subpixels of a pixel; however, a low precision of the source voltages undesirably results in outputting different source voltages for the same image data. This is visually perceived by the user as color unevenness in the region.

One possible cause of deterioration in the precision of the source voltages is manufacturing variations among buffer amplifiers. The buffer amplifiers referred to herein are amplifiers used as output stages that drive the source lines. The buffer amplifiers have a low output impedance in order to drive the source lines having a large load capacitance. The buffer amplifiers have random offset voltages caused by mismatching (or variations) of the semiconductor elements (e.g., MOS (metal oxide semiconductor) transistors)) integrated therein. A large random offset voltage undesirably deteriorates the precision of the source voltage.

To reduce the offset voltage of a buffer amplifier, it is desired to reduce the mismatching among circuit elements in a differential input circuit, which operates as a first stage (input stage) and an active load circuit. It is especially desired to reduce the mismatching among circuit elements in the differential input circuit, because the generation of the offset voltage is mainly governed by the first stage. It is known in the art that increasing the element sizes is especially effective for reducing the mismatching among circuit elements in the differential input circuit and the active load circuit, although improving the symmetricity of the circuit layout and supplying the properly-controlled bias voltages and bias currents are also effective. The increase in the element size, however, undesirably causes an increased parasitic capacitance, reduced operation speed and higher cost.

Due to such background, it is desired to provide a technology for properly addressing the generation of the offset voltage in a buffer amplifier.

Note that Japanese Patent Application Publication No. 2015-211266 discloses one example of the configuration of a differential amplifier circuit used as a buffer amplifier of a display driver that drives a display panel.

SUMMARY OF INVENTION

Therefore, one objective of the present disclosure is to provide a technology for properly addressing the generation of the offset voltage in a buffer amplifier. Other objectives and new features of the present disclosure would be understood by a person skilled in the art from the disclosure given below.

In one embodiment, a display driver is provided which drives a display panel. The display driver includes: a first buffer amplifier associated with a first pixel of the display panel; a second buffer amplifier associated with a second pixel of the display panel, the second pixel being positioned adjacent to the first direction in a horizontal direction; first and second connection switches; and a controller configured to control the first and second connection switches. Each of the first and second buffer amplifiers includes: a differential input circuit including first and second MISFETs of a first conductivity type, the first and second MISFETs having commonly-connected sources; a first drain interconnection connected to a drain of the first MISFET; a second drain interconnection connected to a drain of the second MISFET; an active load circuit connected to the first and second drain interconnections to operate as an active load of the differential input circuit; and an output stage configured to drive an output node in response to voltages on the first and second drain interconnections. A first grayscale voltage generated in response to image data associated with the first pixel is supplied to a gate of one of the first and second MISFET of the first buffer amplifier, and a gate of the other of the first and second MISFET of the first buffer amplifier is connected to the output node of the first buffer amplifier. A second grayscale voltage generated in response to image data associated with the second pixel is supplied to a gate of one of the first and second MISFET of the second buffer amplifier, and a gate of the other of the first and second MISFET of the second buffer amplifier is connected to the output node of the second buffer amplifier. The first connection switch is connected between the output nodes of the first and second buffer amplifiers. The second connection switch is connected between the first drain interconnections of the first and second buffer amplifiers. The controller controls the first and second switches in response to the image data associated with the first and second pixels.

The display driver thus configured is preferably used for driving a display panel in a display device.

The present disclosure provides a technology for properly addressing the generation of the offset voltage in a buffer amplifier.

BRIEF DESCRIPTION OF THE DRAWINGS

The above and other advantages and features of the present invention will be more apparent from the following description taken in conjunction with the accompanied drawings, in which.

DETAILED DESCRIPTION OF PREFERRED EMBODIMENTS

Figure 1:
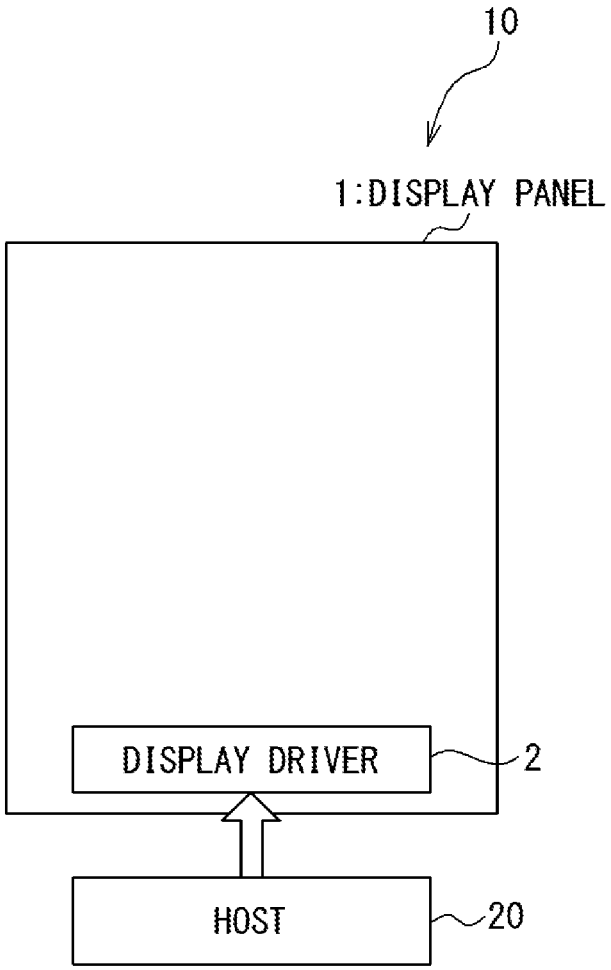
FIG. 1 is a block diagram illustrating an exemplary configuration of a display device in a first embodiment.

The invention will be now described herein with reference to illustrative embodiments. Those skilled in the art would recognize that many alternative embodiments can be accomplished using the teachings of the present invention and that the invention is not limited to the embodiments illustrated for explanatory purposed.

Various embodiments are described in the following with reference to the attached drawings. It should be noted that same or similar components may be denoted by same or corresponding reference numerals and suffixes may be attached to reference numerals to distinguish the same components from each other. It should be also noted that components are not necessarily drawn to scale in the attached drawings, for ease of understanding of the embodiments.

First Embodiment

FIG. 1 is a block diagram illustrating an exemplary configuration of a display device 10 in a first embodiment. The display device 10 includes a display panel 1 and a display driver 2 driving the display panel 1. An OLED display panel or a liquid crystal display panel may be used as the display panel 1, for example. The display device 10 is configured to display an image on the display panel 1 in response to image data and control data received from a host 20 (e.g., an application processor and a CPU (central processing unit)).

Figure 2:
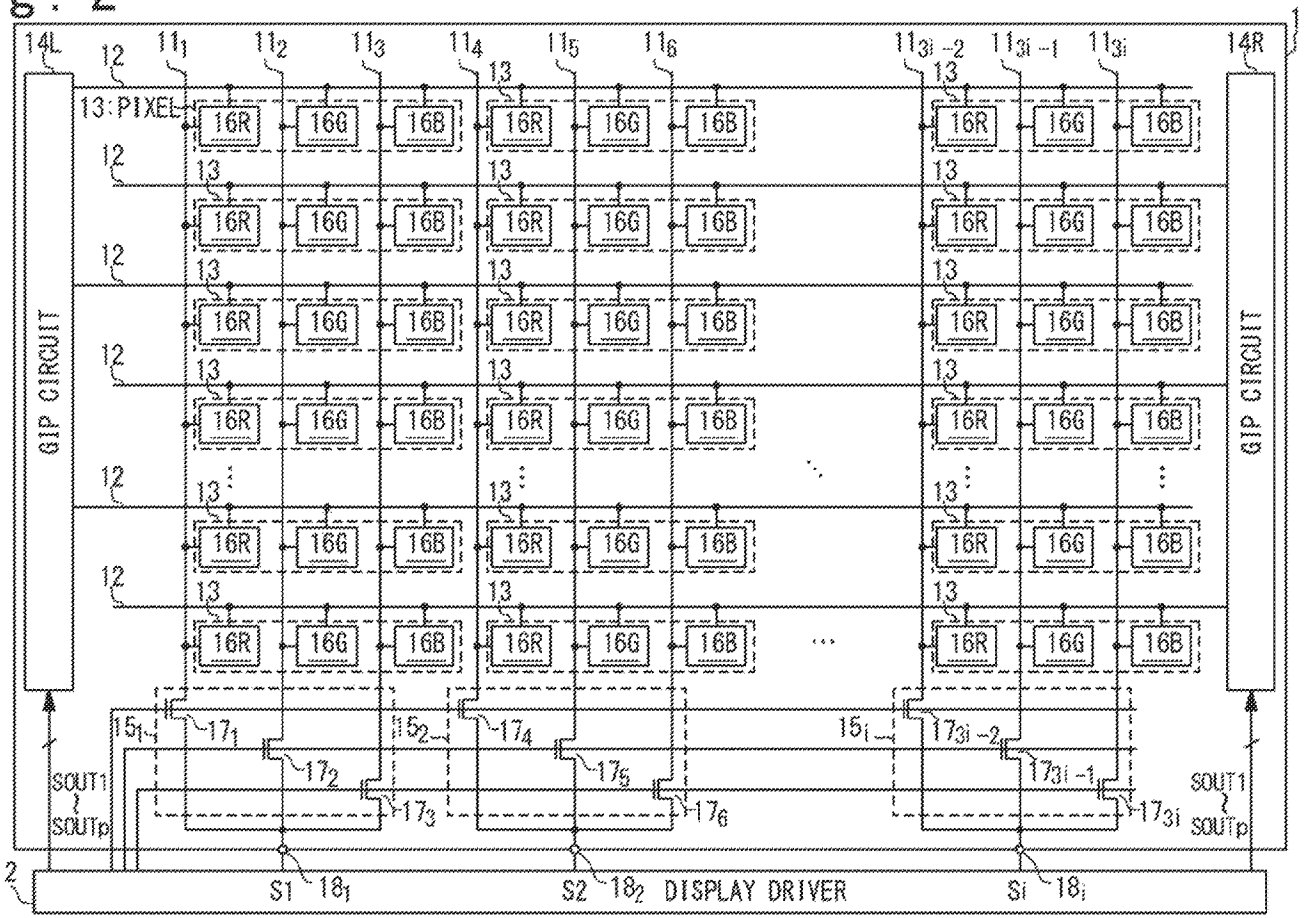
FIG. 2 is a diagram schematically illustrating an exemplary configuration of a display panel in the first embodiment.

FIG. 2 is a diagram schematically illustrating an exemplary configuration of the display panel 1 in the first embodiment. In the present embodiment, the display panel 1 includes source lines 11, gate lines 12, pixels 13 arrayed in rows and columns, GIP (gate-in-panel) circuits 14L, 14R and switch circuits 15. The source lines 11 are arranged to extend in the vertical direction (the Y-axis direction in FIG. 2) and the gate lines 12 are arranged to extend in the horizontal direction (the X-axis direction in FIG. 2.)

Each pixel 13 includes three subpixels arrayed in the horizontal direction: an R subpixel 16R, a G subpixel 16G and a B subpixel 16B. The R subpixel 16R, G subpixel 16G and B subpixel 16B are configured to display the red color (R), green color (G) and blue color (B), respectively. In the following, the R subpixel 16R, G subpixel 16G and B subpixel 16B may be collectively referred to as the subpixels 16, when they are not distinguished from one another.

In the following, pixels 13 which have the R subpixel 16R, G subpixel 16G and B subpixel 16B commonly connected to the same gate line 12 may be referred to as a "horizontal line". In each horizontal sync period, pixels 13 of one horizontal line are selected and the R subpixels 16R, G subpixels 16G and B subpixels 16B of the selected pixels 13 are driven.

Each subpixel 16 includes a pixel circuit. When the display panel 1 is configured as an OLED display panel, in one embodiment, each subpixel 16 includes a selection transistor, a drive transistor, a hold capacitor and an OLED element. When the display panel 1 is configured as a liquid crystal display panel, in one embodiment, each subpixel 16 includes a selection transistor, a hold capacitor and a pixel electrode. The color displayed by each pixel 13 is dependent on the brightness levels of the R subpixel 16R, G subpixels 16G and B subpixels 16B.

In the present embodiment, the display panel 1 includes 3m source lines $\mathbf{11}_1$ to $\mathbf{11}_{3m}$ where m is a natural number of two or more. Each source line 11 is connected to subpixels 16 of the same color. In detail, the (3i−2)-th source line $\mathbf{11}_{3i-2}$ is connected to a column of R subpixels 16R, where i is an integer from one to m. The (3i−1)-th source line $\mathbf{11}_{3i-1}$ is connected to a column of G subpixels 16G and The (3i−1)-th source line $\mathbf{11}_{3i-1}$ is connected to a column of B subpixels 16B.

The GIP circuits 14L and 14R drive the gate lines 12 in response to gate control signals SOUT1 to SOUTp received from the display driver 2. In the present embodiment, the odd-numbered gate lines 12 are driven by the GIP circuit 14L and the even-numbered gate lines 12 are driven by the GIP circuit 14R.

The switch circuits 15 are disposed to implement so-called "time divisional driving". In detail, the switch circuits 15 select source lines 11 to be driven from among the source lines $\mathbf{11}_1$ to $\mathbf{11}_{3m}$, and electrically connect the selected source lines 11 to panel terminals 18. Each panel terminal $\mathbf{18}_i$ is connected to the source output Si of the display driver 2. When a source voltage is supplied to the panel terminal $\mathbf{18}_i$ from the source output Si of the display driver 2, the source voltage is supplied to the source line 11 selected by the switch circuit $15_i$. This allows driving the selected source line 11 to a desired source voltage.

In the present embodiment, one switch circuit 15 is associated with three source lines 11 and each switch circuit 15 electrically connects a selected one of the three associated source lines 11 to the corresponding panel terminal 18. More specifically, each switch circuit $15_i$ includes: a switch $17_{3i-2}$ connected between the source line $11_{3i-2}$ and the panel terminal $18_i$; a switch $17_{3i-1}$ connected between the source line $11_{3i-1}$ and the panel terminal $18_i$; and a switch $17_{3i}$ connected between the source line $11_{3i}$ and the panel terminal $18_i$. The switch $17_{3i-2}$ is turned on and off in response to a switch control signal $S_{SW1}$. Correspondingly, the switch $17_{3i-1}$ is turned on and off in response to a switch control signal $S_{SW2}$ and the switch $17_{3i}$ is turned on and off in response to a switch control signal $S_{SW3}$. This implies that the switch circuit $15_i$ has the function of electrically connecting to the corresponding panel terminal $18_i$ a selected one of the source line $11_{3i-2}$ connected to R subpixels 16R, the source line $11_{3i-1}$ connected to G subpixels 16G and the source line $11_{3i}$ connected to G subpixels 16B.

It should be noted that, with respect to each pixel 13, the source lines 11 connected to the R subpixel 16R, G subpixel 16G and B subpixel 16B of the pixel 13 are connected to the same panel terminal 18, that is, the same source output, via the same switch circuit 15, in the configuration of the display panel 1 of the present embodiment. As described later, desired source voltage are supplied to the R subpixels 16R, G subpixels 16G and B subpixels 16B of the pixels 13 of a selected horizontal line by sequentially selecting the source lines 11 connected to R subpixels 16R, the source lines 11 connected to G subpixels 16G and the source lines 11 connected to B subpixels 16B by the switch circuits 15, and sequentially supplying the source voltages to be written into the R subpixels 16R, G subpixels 16G and B subpixels 16B in synchronization with the selection of the source lines 11. This operation effectively achieves a time-divisional driving scheme.

Figure 3:
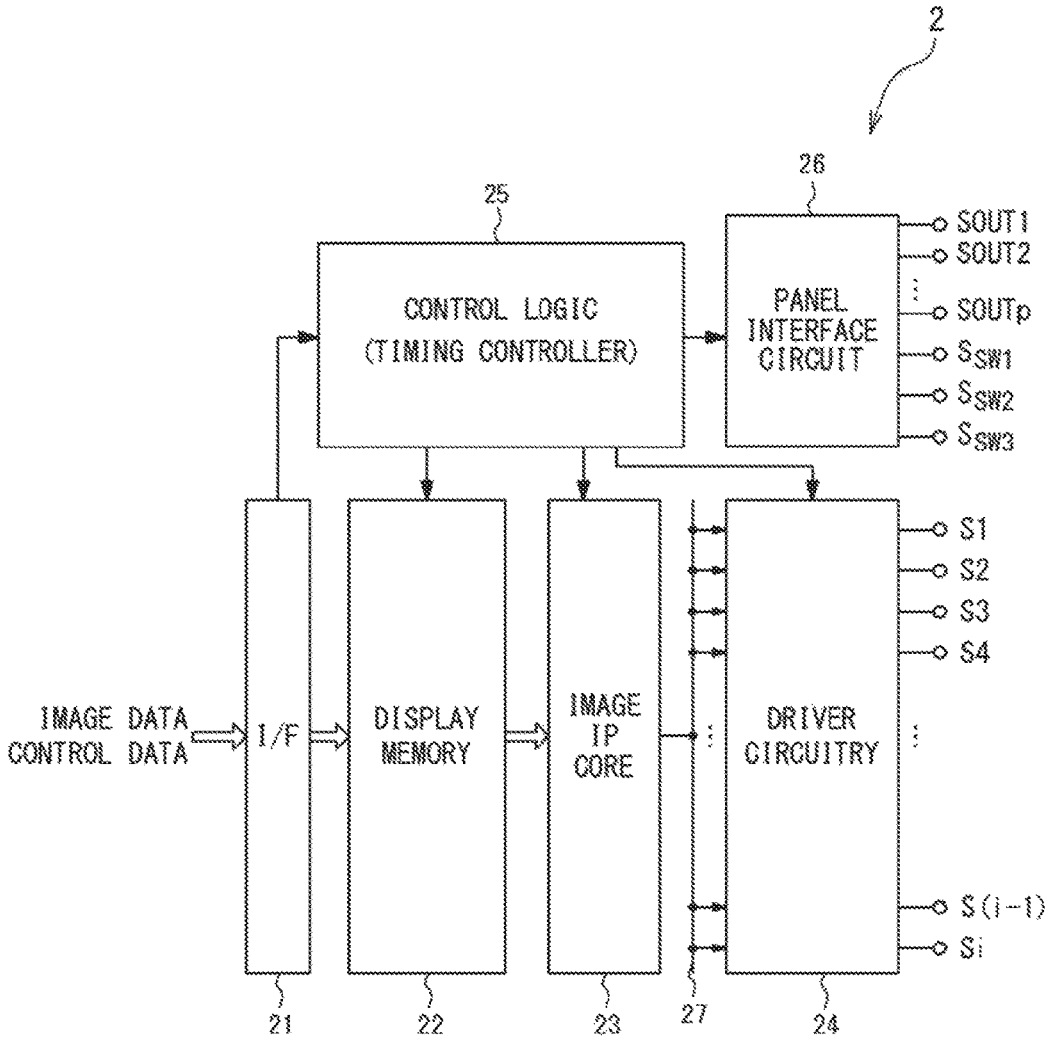
FIG. 3 is a block diagram illustrating an exemplary configuration of a display driver in the first embodiment.

FIG. 3 is a block diagram illustrating an exemplary configuration of the display driver 2 in the present embodiment. The display driver 2 includes an interface 21, a display memory 22, an image IP core 23, a drive circuitry 24, a control logic circuit 25 and a panel interface circuit 26.

The interface 21 communicates with the host 20 to exchange various data required for the operation of the display device 10. More specifically, the interface 21 receives image data from the host 20 and forwards the received image data to the display memory 22. The interface 21 also receives control data from the host 20 and supplies control commands and control parameters to the control logic circuit 25 in response to the contents of the received control data.

The display memory 22 temporarily stores the image data received from the interface 21 and forwards the image data to the image IP core 23. The image IP core 23 performs desired image processing on the image data received from the display memory 22 and outputs the image data obtained by the image processing to the drive circuitry 24.

The drive circuitry 24 is connected to the image IP core 23 via a data bus 27 and is configured to drive the source lines 11 connected to the source outputs S1 to Sm in response to the image data received from the image IP core 23. The configuration of the drive circuitry 24 will be described later in detail.

The control logic circuit 25 controls the respective circuits of the display driver 2 in response to the control commands and control parameters received from the interface 21. The control logic circuit 25 also operates as a timing controller which generates timing control signals used for timing control of the respective circuits of the display driver 2, including the vertical sync signal and the horizontal sync signal.

The panel interface circuit 26 generates the gate control signals SOUT1 to SOUTp which are used for controlling the GIP circuits 14L and 14R, and the switch control signals $S_{SW1}$ to $S_{SW3}$ which are used for controlling the switch circuits 15. The gate control signals SOUT1 to SOUTp and the switch control signals $S_{SW1}$ to $S_{SW3}$ are supplied to the display panel 1.

Figure 4:
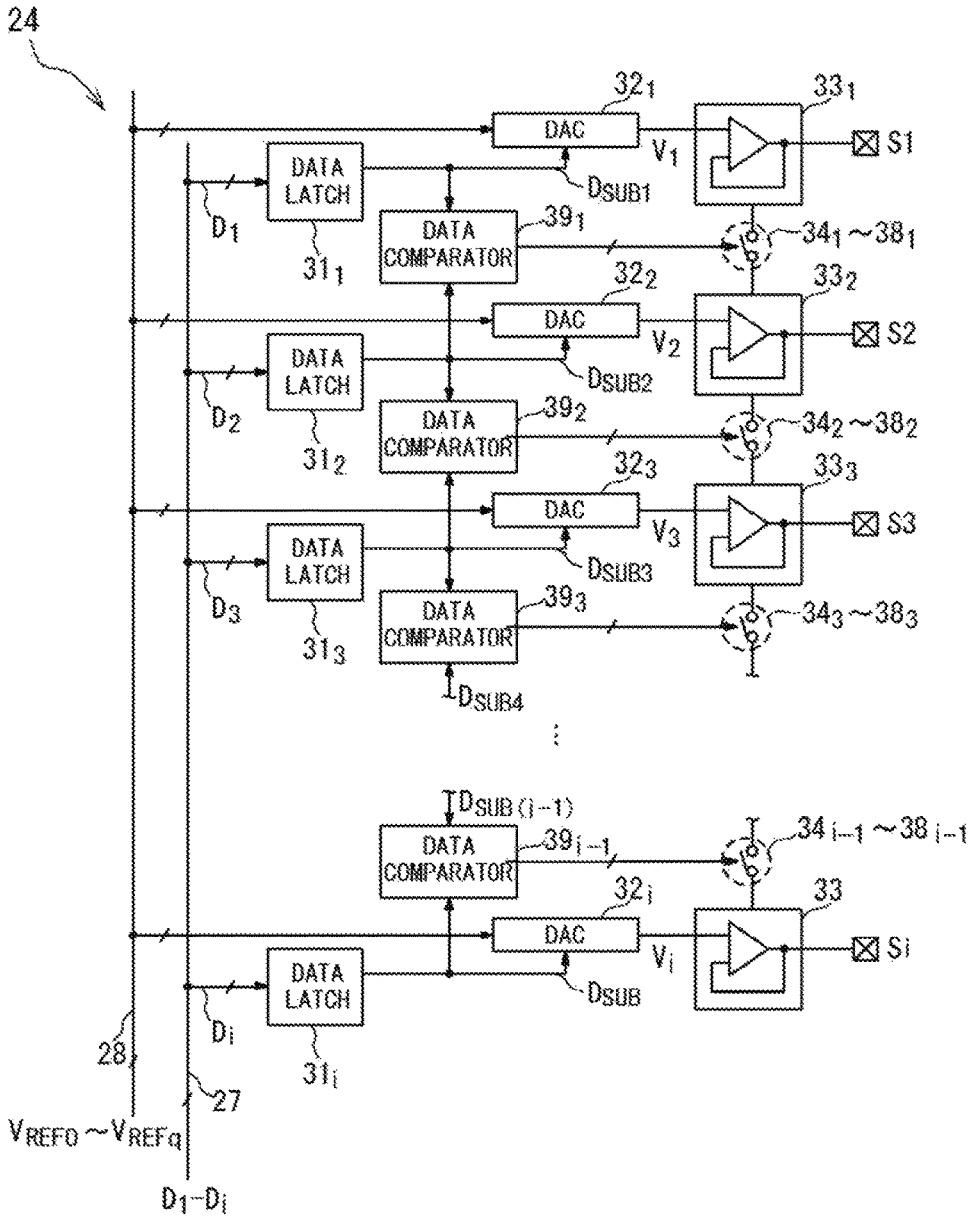
FIG. 4 is a block diagram illustrating an exemplary configuration of a drive circuitry in the first embodiment.

FIG. 4 is a block diagram illustrating an exemplary configuration of the drive circuitry 24 in the present embodiment. The drive circuitry 24 includes data latches 31, DACs (digital-analog converters) 32 and buffer amplifiers 33. In the present embodiment, one data latch 31, one DAC 32, and one buffer amplifier 33 are associated with one source output. It should be noted that, each buffer amplifier 33 time-divisionally drives the R subpixel 16R, G subpixel 16G, and B subpixel 16B of the associated pixel 13 in one horizontal sync period, since the R subpixel 16R, G subpixel 16G, and B subpixel 16B of each pixel 13 are connected to the same source output via the associated switch circuit 15.

Each data latch 31 receives image data of a pixel 13 associated with the source output corresponding thereto from the data bus 27 and stores therein the received image data. In detail, the data latch $31_i$ stores therein the image data $D_i$ of a pixel 13 associated with the source output Si (that is, a pixel 13 connected to the switch circuit $15_i$ connected to the source output Si). It should be noted that image data of a specific pixel 13 includes grayscale data indicative of the respective grayscale levels of the R subpixel 16R, G subpixel 16G, and B subpixel 16B of the specific pixel 13 and in a specific horizontal sync period, image data of the pixels 13 of the horizontal line selected in the specific horizontal sync period are stored in the data latches 31.

In the present embodiment, each data latch 31 is configured to sequentially select grayscale data indicative of the grayscale levels of the R subpixel 16R, G subpixel 16G, and B subpixel 16B, and to output the selected grayscale data to the corresponding DAC 32. In the following, the grayscale data of the R subpixel 16R included in image data $D_i$ may be referred to as R grayscale data and denoted by a symbol "$D_{Ri}$." Similarly, the grayscale data of the G subpixel 16G included in image data $D_i$ may be referred to as G grayscale data and denoted by a symbol "$D_{Gi}$", and the grayscale data of the B subpixel 16B included in image data $D_i$ may be referred to as B grayscale data and denoted by a symbol "$D_{Bi}$." Also, a grayscale data selected by the data latch $31_i$ may be referred to as a selected grayscale data $D_{SUBi}$.

For example, the data latch $31_i$ supplies to the DAC $32_i$ the R grayscale data $D_{Ri}$ of the image data $D_i$ which indicates the grayscale level of a corresponding R subpixel 16R, as the selected grayscale data $D_{SUBi}$ in a period in which the corresponding R subpixel 16R is to be driven. Similarly, the data latch $31_i$ supplies to the DAC $32_i$ the G grayscale data $D_{Gi}$ of the image data $D_i$, which indicates the grayscale level of a corresponding G subpixel 16G, as the selected grayscale data $D_{SUBi}$ in a period in which the corresponding G subpixel 16G is to be driven, and supplies to the DAC $32_i$ the B grayscale data $D_{Bi}$ of the image data $D_i$ which indicates the grayscale level of a corresponding B subpixel 16B as the selected grayscale data $D_{SUBi}$ in a period in which the corresponding B subpixel 16B is to be driven.

The DACs 32 perform digital-analog conversion on the selected grayscale data $D_{SUBi}$ received from the data latches 31 by using reference voltages $V_{REF0}$ to $V_{REFq}$ received from a reference voltage bus 28, where q is a natural number. More specifically, each DAC $32_i$ receives the selected grayscale data $D_{SUBi}$ from the data latch $31_i$ and generates a grayscale voltage $V_i$ having a voltage level corresponding to the selected grayscale data $D_{SUBi}$. The DAC $32_i$ outputs the grayscale voltage $V_i$ thus generated to the corresponding buffer amplifier $33_i$.

The buffer amplifiers 33 output source voltages having voltage levels corresponding to the grayscale voltages received from the corresponding DACs 32. In the present embodiment, each buffer amplifier $33_i$ is configured as a voltage follower which outputs to the source output Si a source voltage having the same voltage level as the grayscale voltage $V_i$ received from the DAC $32_i$.

As discussed above, the buffer amplifiers 33 inevitably have offset voltages and this may undesirably cause deterioration in the display image quality. To address this problem, the drive circuitry 24 includes connections switches 34 to 38 and data comparators 39. In FIG. 4, the connection switches 34 to 38 which connect the buffer amplifiers $33_i$ and $33_{i+1}$ are denoted by the numerals $34_i$ to $38_i$.

As described later, the connection switches $34_i$ to $38_i$ are configured to electrically connect the output nodes and internal nodes of the buffer amplifiers $33_i$ and $33_{i+1}$. Although five connection switches $34_i$ to $38_i$ are connected between the buffer amplifiers $33_i$ and $33_{i+1}$ in the present embodiment as described later (also see FIG. 5A), only one switch symbol is illustrated between the buffer amplifiers $33_i$ and $33_{i+1}$ to collectively denote the connection switches $34_i$ to $38_i$ in FIG. 4.

On the basis of image data associated with pixels 13 corresponding to every adjacent two buffer amplifiers 33, the data comparators 39 perform on-off control of the connection switches 34 to 38 connected between every adjacent two buffer amplifiers 33. More specifically, the data comparator $39_i$ receives the selected grayscale data $D_{SUBi}$ from the data latch $31_i$ and receives the selected grayscale data $D_{SUB(i+1)}$ from the data latch $31_{i+1}$. The data comparator $39_i$ compares the selected grayscale data $D_{SUBi}$ and $D_{SUB(i+1)}$ and turns on or off the connection switches $34_i$ to $38_i$ on the basis of the comparison result.

In the present embodiment, the data comparator $39_i$ turns on the connection switches $34_i$ to $38_i$ when the selected grayscale data $D_{SUBi}$ received from the data latch $31_i$ is same as the selected grayscale data $D_{SUB(i+1)}$ received from the data latch $31_{i+1}$; otherwise, the data comparator $39_i$ turns off the connection switches $34_i$ to $38_i$. As discussed later in detail, when subpixels 16 of the same color of two pixels 13 adjacent in the horizontal direction are to be driven to the same grayscale level, the two buffer amplifiers 33 associated with the two pixels 16 are electrically connected as the result of the operations of the relevant connection switches 34 to 38 and the relevant data comparator 39 in the present embodiment. This effectively eliminates the difference in the offset voltage between the two buffer amplifiers 33.

Figure 5A:
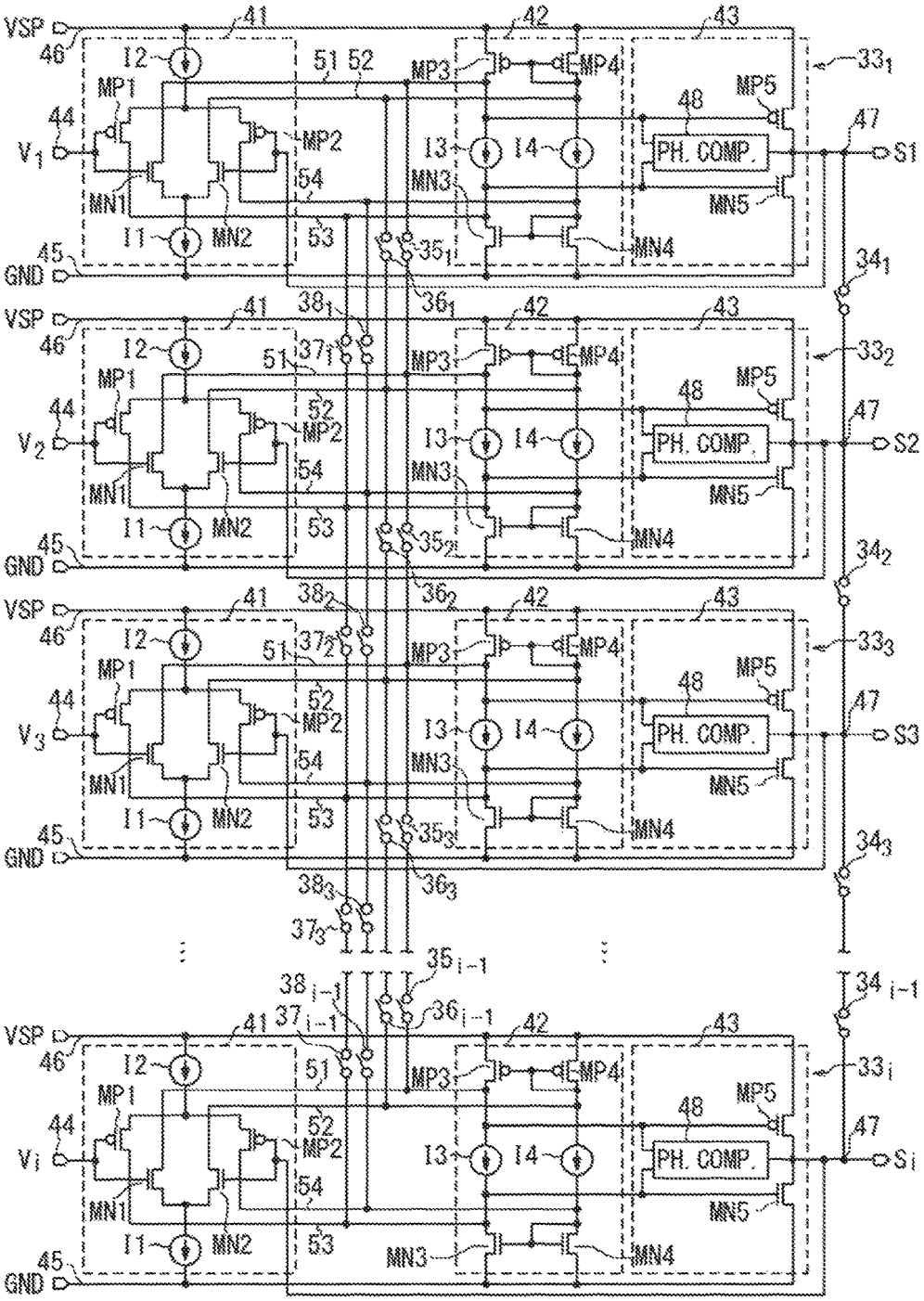
FIG. 5A is a circuit diagram illustrating one example of the configuration of the respective buffer amplifiers and the connections of the connection switches between adjacent buffer amplifiers in the first embodiment.

FIG. 5A is a circuit diagram illustrating an exemplary configuration of the buffer amplifiers 33 and the connections between adjacent two buffer amplifiers 33 with the connection switches 34 to 38.

In the present embodiment, each buffer amplifier $33_i$ includes a differential input circuit 41, an active load circuit 42 and an output stage 43, and is configured to output to the source output Si a source voltage having the same voltage level as the grayscale voltage $V_i$ supplied to an input node 44.

The differential input circuit 41 includes NMOS transistors MN1, MN2, PMOS transistors MP1, MP2 and constant current sources I1 and I2. As is well-known in the art, the NMOS transistor is a sort of the N-channel MISFET (metal insulator semiconductor field effect transistor) and the PMOS transistor is a sort of the P-channel MISFET.

The NMOS transistors MN1 and MN2 have commonly-connected sources to form a differential transistor pair. In detail, the sources of the NMOS transistors MN1 and MN2 are commonly connected to the constant current source I1. The gate of the NMOS transistor MN1 is connected to the input node 44 and the gate of the NMOS transistor MN2 is connected to the output node 47. The drain of the NMOS transistor MN1 is connected to a drain interconnection 51 and the drain of the NMOS transistor MN2 is connected to a drain interconnection 52.

The PMOS transistors MP1 and MP2 have commonly-connected sources to form another differential transistor pair. In detail, the sources of the PMOS transistors MP1 and MP2 are commonly connected to the constant current source I2. The gate of the PMOS transistor MP1 is connected to the input node 44 and the gate of the PMOS transistor MP2 is connected to the output node 47. The drain of the PMOS transistor MP1 is connected to a drain interconnection 53 and the drain of the PMOS transistor MP2 is connected to a drain interconnection 54.

The constant current source I1 is connected between a negative-side line 45 and the commonly-connected sources of the NMOS transistors MN1 and MN2, and draws a constant current from the commonly-connected sources of the NMOS transistors MN1 and MN2 to the negative-side line 45. In the present embodiment, the potential of the negative-side line 45 is set to the circuit ground level (GND).

The constant current source I2 is connected between a positive-side line 46 and the commonly-connected sources of the PMOS transistors MP1 and MP2, and draws a constant current from the positive-side line 46 to the commonly-connected sources of the PMOS transistors MP1 and MP2. In the present embodiment, the potential of the negative-side line 45 is set to a given potential VSP.

The active load circuit 42 operates as an active load connected to the drain interconnections 51 to 54, that is, an active load of the differential input circuit 41. In the present embodiment, the active load circuit 42 includes NMOS transistors MN3, MN4, PMOS transistors MP3, MP4 and constant current sources I3 and I4.

The NMOS transistors MN3 and MN4 form a current mirror connected to the drain interconnections 53 and 54. The NMOS transistors MN3 and MN4 have sources commonly connected to the negative-side line 45 and gates commonly connected to the drain of the NMOS transistor MN4. The drains of the NMOS transistors MN3 and MN4 are connected to the drain interconnections 53 and 54, respectively.

The PMOS transistors MP3 and MP4 form a current mirror connected to the drain interconnections 51 and 52. The PMOS transistors MP3 and MP4 have sources commonly connected to the positive-side line 46 and gates commonly connected to the drain of the PMOS transistor MP4. The drains of the PMOS transistors MP3 and MP4 are connected to the drain interconnections 51 and 52, respectively.

The constant current source I3 is connected between the drain of the PMOS transistor MP3 and the drain of the NMOS transistor MN3, and draws a constant current from the drain of the PMOS transistor MP3 to the drain of the NMOS transistor MN3. Similarly, the constant current source I4 is connected between the drain of the PMOS transistor MP4 and the drain of the NMOS transistor MN4, and draws a constant current flowing from the drain of the PMOS transistor MP4 to the drain of the NMOS transistor MN4.

The output stage 43 drives the output node 47 in response to the voltages on the drain interconnections 51 to 54. In the present embodiment, the drain of the PMOS transistor MP3 of the active load circuit 42 is connected to the drain interconnection 51, and the drain of the NMOS transistor MN3 is connected to the drain interconnection 53. The output stage 43 is configured to drive the output node 47 in response to the voltages received from the drains of the PMOS transistor MP3 and the NMOS transistor MN3.

More specifically, the output stage 43 includes a PMOS transistor MP5, an NMOS transistor MN5 and a phase compensation circuit 48 in the present embodiment. The PMOS transistor MP5 and the NMOS transistor MN5 operate as output transistors that drive the output node 47. The PMOS transistor MP5 has a source connected to the positive-side line 46, a drain connected to the output node 47 and a gate connected to the drain of the PMOS transistor MP3. The NMOS transistor MN5 has a source connected to the negative-side line 45, a drain connected to the output node 47 and a gate connected to the drain of the NMOS transistor MN3. The phase compensation circuit 48 is connected to the output node 47 and the gates of the PMOS transistor MP5 and the NMOS transistor MN5, to perform phase compensation of the buffer amplifier 33.

The connection switches 34 to 38 electrically connect adjacent buffer amplifiers under the control by the data comparators 39. In detail, the connection switch $\mathbf{34}_i$ is connected between the output nodes 47 of the buffer amplifiers $\mathbf{33}_i$ and $\mathbf{33}_{i+1}$, to provide an electrical connection between the output nodes 47 of the buffer amplifiers $\mathbf{33}_i$ and $\mathbf{33}_{i+1}$ (or to achieve short-circuiting between the output nodes 47 of the buffer amplifiers $\mathbf{33}_i$ and $\mathbf{33}_{i+1}$.)

The connection switch $\mathbf{35}_i$ is connected between the drain interconnections 51 of the buffer amplifiers $\mathbf{33}_i$ and $\mathbf{33}_{i+1}$, to provide an electrical connection between the drain interconnections 51 of the buffer amplifiers $\mathbf{33}_i$ and $\mathbf{33}_{i+1}$ (in other words, to provide an electrical connection between the drains of the PMOS transistors MP3 of the active load circuits 42 of the buffer amplifiers $\mathbf{33}_i$ and $\mathbf{33}_{i+1}$.) The connection switch $\mathbf{36}_i$ is connected between the drain interconnections 52 of the buffer amplifiers $\mathbf{33}_i$ and $\mathbf{33}_{i+1}$, to provide an electrical connection between the drain interconnections 52 of the buffer amplifiers $\mathbf{33}_i$ and $\mathbf{33}_{i+1}$ (in other words, to provide an electrical connection between the drains of the PMOS transistors MP4 of the active load circuits 42 of the buffer amplifiers $\mathbf{33}_i$ and $\mathbf{33}_{i+1}$.)

Similarly, the connection switch $\mathbf{37}_i$ is connected between the drain interconnections 53 of the buffer amplifiers $\mathbf{33}_i$ and $\mathbf{33}_{i+1}$, to provide an electrical connection between the drain interconnections 53 of the buffer amplifiers $\mathbf{33}_i$ and $\mathbf{33}_{i+1}$ (in other words, to provide an electrical connection between the drains of the NMOS transistors MN3 of the active load circuits 42 of the buffer amplifiers $\mathbf{33}_i$ and $\mathbf{33}_{i+1}$.) The connection switch $\mathbf{38}_i$ is connected between the drain interconnections 54 of the buffer amplifiers $\mathbf{33}_i$ and $\mathbf{33}_{i+1}$, to provide an electrical connection between the drain interconnections 54 of the buffer amplifiers $\mathbf{33}_i$ and $\mathbf{33}_{i+1}$ (in other words, to provide an electrical connection between the drains of the NMOS transistors MN4 of the active load circuits 42 of the buffer amplifiers $\mathbf{33}_i$ and $\mathbf{33}_{i+1}$.)

Figure 6:
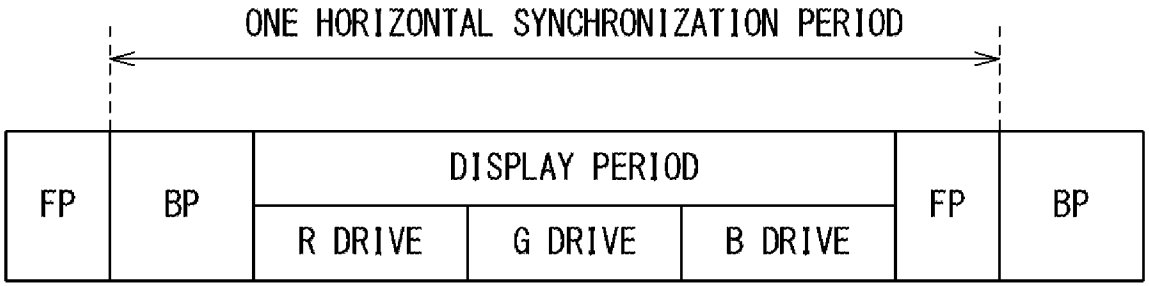
FIG. 6 is a timing chart illustrating an exemplary operation of the display driver in the first embodiment.

Next, a description is given of an exemplary operation of the display driver 2 in the present embodiment. FIG. 6 is a timing chart illustrating the operation of the display driver 2 in the present embodiment.

In the display device 10 of the present embodiment, each horizontal sync period includes a front porch period, a display period and a front porch period.

In the back porch period, a horizontal line to be driven is selected and the gate line 12 corresponding to the selected horizontal line is activated. This is followed by writing image data associated with the pixels 13 of the selected horizontal line into the data latches 31. More specifically, image data $D_i$ to $D_m$ of the pixels 13 positioned in the selected horizontal line and associated with the source outputs S1 to Sm are written into the data latches $\mathbf{31}_1$ to $\mathbf{31}_m$, respectively.

In the display period following the back porch period, the subpixels 16 of the pixels 13 of the selected horizontal line are time-divisionally driven. In the front porch period following the display period, a preparation operation is performed to drive the respective subpixels 16 of pixels 13 of the next horizontal line in the next horizontal sync period.

In the present embodiment, the display period includes an R drive period, a G drive period and a B drive period. The R drive period is a period in which R subpixels 16R of the pixels 13 of the selected horizontal line are driven. Similarly, the G drive period is a period in which G subpixels 16G of the pixels 13 of the selected horizontal line are driven and the B drive period is a period in which B subpixels 16B of the pixels 13 of the selected horizontal line are driven. The G drive period follows the R drive period in the time domain, and the B drive period follows the G drive period in the time domain. In other words, the R subpixels 16R, G subpixels 16G and B subpixels 16B of the pixels 13 of the selected horizontal line are driven in this order.

More specifically, in the R drive period, each data latch $\mathbf{31}_i$ selects the R grayscale data $D_{Ri}$, which indicates the associated R subpixel 16R, from the image data $D_i$, and supplies the R grayscale data $D_{Ri}$ to the DAC $\mathbf{32}_i$ as the selected grayscale data $D_{SUBi}$. The DAC $\mathbf{32}_i$ generates the grayscale voltage $V_i$ corresponding to the R grayscale data $D_{Ri}$ and supplies the grayscale voltage $V_i$ thus generated to the buffer amplifier $\mathbf{33}_i$. Each buffer amplifier $\mathbf{33}_i$ outputs to the corresponding source output Si a source voltage having the same voltage level as the grayscale voltage $V_i$ received from the DAC $\mathbf{32}_i$.

Additionally, the switch control signal $S_{SW1}$ is activated in the R drive period, and the switch $\mathbf{17}_{3i-2}$, which is connected to the source line 11 connected to the relevant R subpixel 16R, is turned on in each switch circuit $\mathbf{15}_i$ of the display panel 1. In parallel, the switch control signals $S_{SW2}$ and $S_{SW3}$ are deactivated and the switches $\mathbf{17}_{3i-1}$ and $\mathbf{17}_{3i}$ are turned off. In other words, each switch circuit $\mathbf{15}_i$ connects the source line 11 connected to the relevant R subpixel 16R to the panel terminal 18*i*, that is, the source output Si. This allows supplying the source voltage generated on the source output Si to the R subpixel 16R of the pixel 13 of the selected horizontal line, which is associated with the source output Si.

In parallel, each data comparator $\mathbf{39}_i$ compares the selected grayscale data $D_{SUBi}$ received from the data latch $\mathbf{31}_i$ with the grayscale data $D_{SUB(i+1)}$ received from the data latch $\mathbf{31}_{i+1}$, and turns on the switches $\mathbf{34}_i$ to $\mathbf{38}_i$ when the selected grayscale data $D_{SUBi}$ is same as the selected grayscale data $D_{SUB(i+1)}$. Since the R grayscale data $D_{Ri}$ and $D_{R(i+1)}$ are selected as the selected grayscale data $D_{SUBi}$ and $D_{SUB(i+1)}$ in the R drive period, each data comparator $\mathbf{39}_i$ turns on the switches $34_i$ to $38_i$ when the R grayscale data $D_{Ri}$ and $D_{R(i+1)}$ are same, that is, when the grayscale levels of the R subpixels 16R indicated by the image data $D_i$ and $D_{i+1}$ associated with the pixels 13 corresponding to the buffer amplifiers $33_i$ and $33_{i+1}$ are equal to each other. This allows electrically connecting the adjacent buffer amplifiers 33 to make the source voltages supplied to the R subpixels 16R of the adjacent pixels 13 equal to each other.

When the selected grayscale data $D_{SUBi}$ and $D_{SUB(i+1)}$ are different (that is, the R grayscale data $D_{Ri}$ and $D_{R(i+1)}$ are different), on the other hand, the data comparator $39_i$ turns off the connection switches $34_i$ to $38_i$. In this case, the R subpixels 16R of adjacent pixels 13 are driven to have different brightness levels.

In the following G drive period, each data latch $31_i$ selects the G grayscale data $D_{Gi}$ which indicates the grayscale level of the corresponding G subpixel 16G from the image data $D_i$, and supplies the G grayscale data $D_{Gi}$ to the DAC $32_i$ as the selected grayscale data $D_{SUBi}$. The DAC $32_i$ generates the grayscale voltage $V_i$ corresponding to the G grayscale data $D_{Gi}$ and supplies the grayscale voltage $V_i$ thus generated to the buffer amplifier $33_i$. Each buffer amplifier $33_i$ outputs to the corresponding source output Si a source voltage having the same voltage level as the grayscale voltage $V_i$ received from the DAC $32_i$.

Additionally, the switch control signal $S_{SW2}$ is activated in the G drive period, and the switch $17_{3i-1}$, which is connected to the source line 11 connected to the relevant G subpixel 16G, is turned on in each switch circuit 15, of the display panel 1. In parallel, the switch control signals $S_{SW1}$ and $S_{SW3}$ are deactivated and the switches $17_{3i-2}$ and $17_{3i}$ are turned off. In other words, each switch circuit $15_i$ connects the source line 11 connected to the relevant G subpixel 16G to the panel terminal 18*i*, that is, the source output Si. This allows supplying the source voltage generated on the source output Si to the G subpixel 16G of the pixel 13 of the selected horizontal line, which is associated with the source output Si.

In parallel, each data comparator $39_i$ compares the selected grayscale data $D_{SUBi}$ received from the data latch $31_i$ with the grayscale data $D_{SUB(i+1)}$ received from the data latch $31_{i+1}$, and turns on the switches $34_i$ to $38_i$ when the selected grayscale data $D_{SUBi}$ is same as the selected grayscale data $D_{SUB(i+1)}$. Since the G grayscale data $D_{Gi}$ and $D_{G(i+1)}$ are selected as the selected grayscale data $D_{SUBi}$ and $D_{SUB(i+1)}$ in the G drive period, each data comparator $39_i$ turns on the switches $34_i$ to $38_i$ when the G grayscale data $D_{Gi}$ and $D_{G(i+1)}$ are same, that is, when the grayscale levels of the G subpixels 16G indicated by the image data $D_i$ and $D_{i+1}$ associated with the pixels 13 corresponding to the buffer amplifiers $33_i$ and $33_{i+1}$ are equal to each other.

In the following B drive period, each data latch $31_i$ selects the B grayscale data $D_{Bi}$ which indicates the corresponding B subpixel 16B from the image data $D_i$, and supplies the B grayscale data $D_{Bi}$ to the DAC $32_i$ as the selected grayscale data $D_{SUBi}$. The DAC $32_i$ generates the grayscale voltage $V_i$ corresponding to the B grayscale data $D_{Bi}$ and supplies the grayscale voltage $V_i$ thus generated to the buffer amplifier $33_i$. Each buffer amplifier $33_i$ outputs to the corresponding source output Si a source voltage having the same voltage level as the grayscale voltage $V_i$ received from the DAC $32_i$.

Additionally, the switch control signal $S_{SW3}$ is activated in the B drive period, and the switch $17_{3i}$, which is connected to the source line 11 connected to the relevant B subpixel 16B, is turned on in each switch circuit $15_i$ of the display panel 1. In parallel, the switch control signals $S_{SW1}$ and $S_{SW2}$ are deactivated and the switches $17_{3i-2}$ and $17_{3i-1}$ are turned off. In other words, each switch circuit $15_i$ connects the source line 11 connected to the relevant B subpixel 16B to the panel terminal 18*i*, that is, the source output Si. This allows supplying the source voltage generated on the source output Si to the B subpixel 16B of the pixel 13 of the selected horizontal line, which is associated with the source output Si.

In parallel, each data comparator $39_i$ compares the selected grayscale data $D_{SUBi}$ received from the data latch $31_i$ with the grayscale data $D_{SUB(i+1)}$ received from the data latch $31_{i+1}$, and turns on the switches $34_i$ to $38_i$ when the selected grayscale data $D_{SUBi}$ is same as the selected grayscale data $D_{SUB(i+1)}$. Since the B grayscale data $D_{Bi}$ and $D_{B(i+1)}$ are selected as the selected grayscale data $D_{SUBi}$ and $D_{SUB(i+1)}$ in the B drive period, each data comparator $39_i$ turns on the switches $34_i$ to $38_i$ when the B grayscale data $D_{Bi}$ and $D_{B(i+1)}$ are same, that is, when the grayscale levels of the B subpixels 16B indicated by the image data $D_i$ and $D_{i+1}$ associated with the pixels 13 corresponding to the buffer amplifiers $33_i$ and $33_{i+1}$ are equal to each other.

As thus discussed, in the present embodiment, adjacent buffer amplifiers 33 are electrically connected when the R grayscale data of image data of two pixels 13 adjacent in the horizontal direction are same, and this allows making the source voltages supplied to the R subpixels 16R of the adjacent two pixels 13 equal to each other. This operation allows making the brightness levels of the R subpixels 16R of the adjacent pixels 13 substantially equal to each other when the grayscale levels of the R subpixels 16R of the adjacent pixels 13 indicated by the image data associated with the adjacent pixels 13 are equal to each other, even if the adjacent buffer amplifiers 33 have different offset voltages.

The similar goes for the G subpixels 16G and B subpixels 16B. In the present embodiment, adjacent buffer amplifiers 33 are electrically connected when the G grayscale data of image data of two pixels 13 adjacent in the horizontal direction are same, and this allows making the source voltages supplied to the G subpixels 16G of the adjacent two pixels 13 equal to each other. This operation allows making the brightness levels of the G subpixels 16G of the adjacent two pixels 13 substantially equal to each other when the grayscale levels of the G subpixels 16G of the adjacent two pixels 13 indicated by the image data associated with the adjacent pixels 13 are equal to each other, even if the adjacent buffer amplifiers 33 have different offset voltages. Furthermore, adjacent buffer amplifiers 33 are electrically connected when the grayscale levels of the B subpixels 16B indicated by the image data of two pixels 13 adjacent in the horizontal direction are same, and this allows making the source voltages supplied to the B subpixels 16B of the adjacent two pixels 13 equal to each other.

The configuration of the drive circuitry 24 is based on a fact that simply electrically connecting the output nodes 47 of adjacent buffer amplifiers 33 does not make the voltages generated on the output nodes 47 of the buffer amplifiers 33 equal to each other. This is because the buffer amplifiers 33, which are used to drive the source lines 11, are designed to have a low output impedance. Since the source lines 11 have a large capacitance, it is desired to reduce the output impedance of the buffer amplifiers 33 to rapidly drive the source lines 11. When the buffer amplifiers 33 have a low output impedance while there is a difference in the offset voltage between the adjacent two buffer amplifiers 33, connecting the output nodes 47 of adjacent two buffer amplifiers 33 a connection switch 34 does not make the source voltages output from the output nodes 47 equal to each other due to a voltage drop generated across the connection switch 34.

In the configuration of the drive circuitry 24 of the present embodiment, when the selected grayscale data selected for two pixels 13 adjacent in the horizontal direction are same, the drain interconnections 51 to 54 of the corresponding adjacent two buffer amplifiers 33 are electrically connected by the connection switches 35 to 38, while the output nodes 47 of the adjacent two buffer amplifiers 33 are also electrically connected by the connection switch 34. This operation effectively reduces the difference between the source voltages output from the adjacent two buffer amplifiers 33.

More specifically, when the selected grayscale data $D_{SUBi}$ and $D_{SUB(i+1)}$ are same, the connection switch $\mathbf{35}_i$ is turned on to electrically connect the drain interconnections 51 of the adjacent buffer amplifiers $\mathbf{33}_i$ and $\mathbf{33}_{i+1}$. This effectively reduces the difference between the voltages generated on the drain interconnections 51 of the adjacent buffer amplifiers $\mathbf{33}_i$ and $\mathbf{33}_{i+1}$. Furthermore, when the selected grayscale data $D_{SUBi}$ and $D_{SUB(i+1)}$ are same, the connection switch $\mathbf{36}_i$ is turned on to electrically connect the drain interconnections 52 of the adjacent buffer amplifiers $\mathbf{33}_i$ and $\mathbf{33}_{i+1}$. This effectively reduces the difference between the voltages generated on the drain interconnections 52 of the adjacent buffer amplifiers $\mathbf{33}_i$ and $\mathbf{33}_{i+1}$.

Also, when the selected grayscale data $D_{SUBi}$ and $D_{SUB(i+1)}$ are same, the connection switch $\mathbf{37}_i$ is turned on to electrically connect the drain interconnections 53 of the adjacent buffer amplifiers $\mathbf{33}_i$ and $\mathbf{33}_{i+1}$. This effectively reduces the difference between the voltages generated on the drain interconnections 53 of the adjacent buffer amplifiers $\mathbf{33}_i$ and $\mathbf{33}_{i+1}$. Furthermore, the selected grayscale data $D_{SUBi}$ and $D_{SUB(i+1)}$ are same, the connection switch $\mathbf{38}_i$ is turned on to electrically connect the drain interconnections 54 of the adjacent buffer amplifiers $\mathbf{33}_i$ and $\mathbf{33}_{i+1}$. This effectively reduces the difference between the voltages generated on the drain interconnections 54 of the adjacent buffer amplifiers $\mathbf{33}_i$ and $\mathbf{33}_{i+1}$.

The above-described operation allows extremely reducing the difference between the source voltages generated on the output nodes 47 of the adjacent buffer amplifiers $\mathbf{33}_i$ and $\mathbf{33}_{i+1}$, since the difference in the gate voltages of the output transistors (the PMOS transistors MP5 and NMOS transistor MN5) of the output stages 43 is reduced (ideally to zero) between the adjacent buffer amplifiers $\mathbf{33}_i$ and $\mathbf{33}_{i+1}$.

It should be noted that, in the present embodiment, the effect of reducing the difference between the source voltages output from the adjacent buffer amplifiers $\mathbf{33}_i$ and $\mathbf{33}_{i+1}$ can be obtained by electrically connecting only the drain interconnections 51 of the adjacent buffer amplifiers $\mathbf{33}_i$ and $\mathbf{33}_{i+1}$ or by electrically connecting only the drain interconnections 52 of the adjacent buffer amplifiers $\mathbf{33}_i$ and $\mathbf{33}_{i+1}$. It should be also noted that the effect of reducing the difference between the source voltages output from the adjacent buffer amplifiers $\mathbf{33}_i$ and $\mathbf{33}_{i+1}$ can be obtained by electrically connecting only the drain interconnections 53 of the adjacent buffer amplifiers $\mathbf{33}_i$ and $\mathbf{33}_{i+1}$ or by electrically connecting only the drain interconnections 54 of the adjacent buffer amplifiers $\mathbf{33}_i$ and $\mathbf{33}_{i+1}$.

In other words, the effect of reducing the difference between the source voltages output from adjacent buffer amplifiers 33 and 33 can be obtained by incorporating only the connection switches 35 or by incorporating only the connection switches 36. Similarly, the effect of reducing the difference between the source voltages output from adjacent buffer amplifiers 33 and 33 can be obtained by incorporating only the connection switches 37 or by incorporating only the connection switches 38.

Accordingly, the drive circuitry 24 may incorporate only the connection switches 35 out of the connection switches 35 to 38, or incorporate only the connection switches 36. Also, the drive circuitry 24 may incorporate only the connection switches 37 out of the connection switches 35 to 38, or incorporate only the connection switches 38.

In an alternative embodiment, the drive circuitry 24 may incorporate only the connection switches 35 and 37 out of the connection switches 35 to 38. In this configuration, when the connection switches 35 and 37 connected between adjacent buffer amplifiers 33 are turned on, the drain interconnections 51 connected to the drains of the PMOS transistors MP3 are electrically connected between the adjacent buffer amplifiers 33 and the drain interconnections 53 connected to the drains of the NMOS transistors MN3 are electrically connected between the adjacent buffer amplifiers 33. In the configuration illustrated in FIG. 5A, in which the drain interconnections 51 are connected to the gates of the PMOS transistors MP5 of the output stages 43 (without any elements intervening) and the drain interconnections 53 are connected to the gates of the NMOS transistors MN5 (without any elements intervening), short-circuiting the drain interconnections 51 and 53 between adjacent buffer amplifiers 33 causes a large effect of reducing the difference between the source voltages output from the adjacent buffer amplifiers 33. Accordingly, the above-described configuration effectively achieves an effect of reducing the difference between the source voltages output from the adjacent buffer amplifiers 33.

It should be noted however that the largest effect of reducing the difference between the source voltages output from the adjacent buffer amplifiers 33 can be obtained when the drive circuitry 24 incorporates all of the connection switches 35 to 38. Accordingly, it is preferable that the drive circuitry 24 incorporates all of the connection switches 35 to 38 as illustrated in FIG. 5A.

Figure 5B:
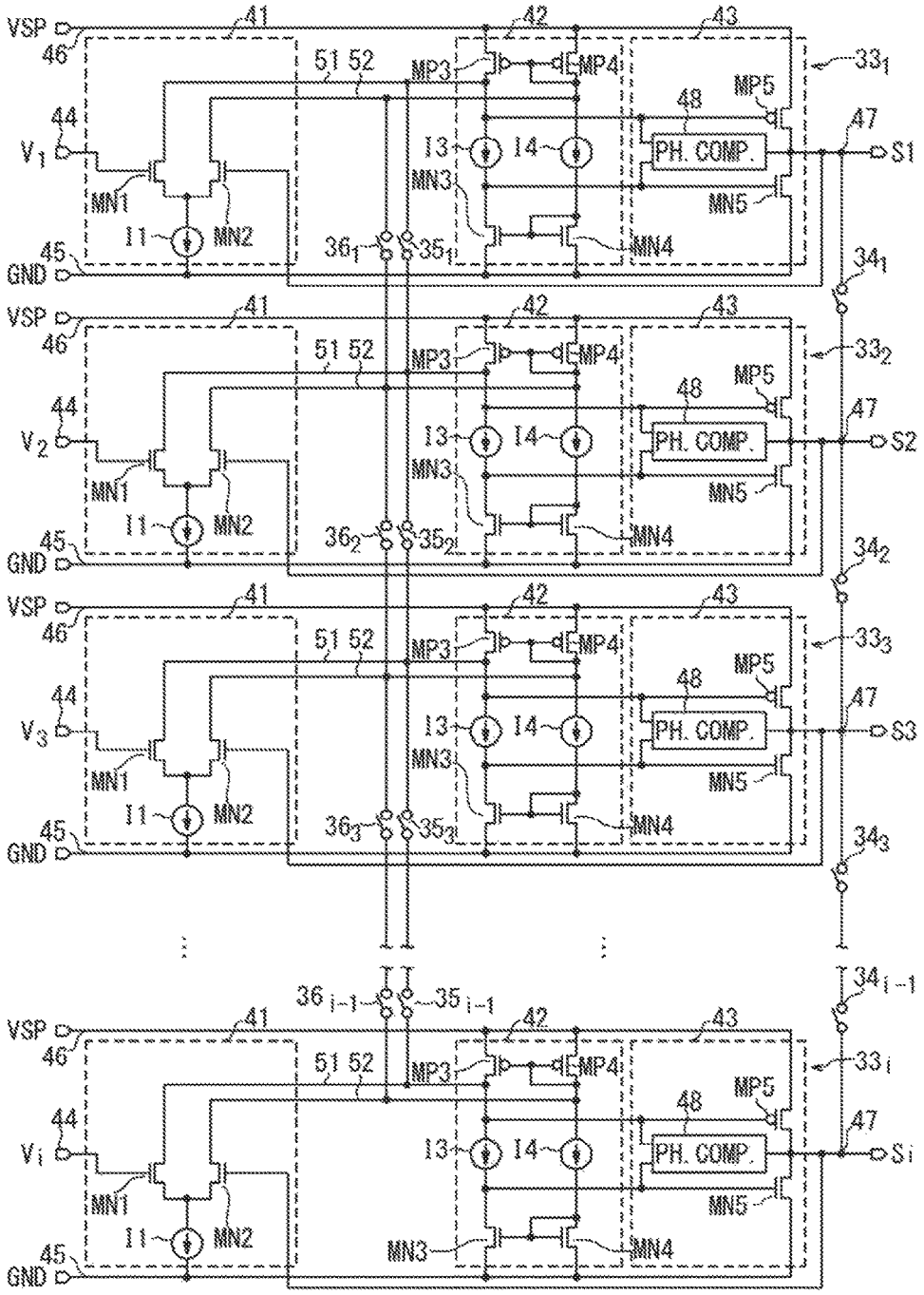
FIG. 5B is a circuit diagram illustrating another example of the configuration of the respective buffer amplifiers and the connections of the connection switches between adjacent buffer amplifiers.
Figure 5C:
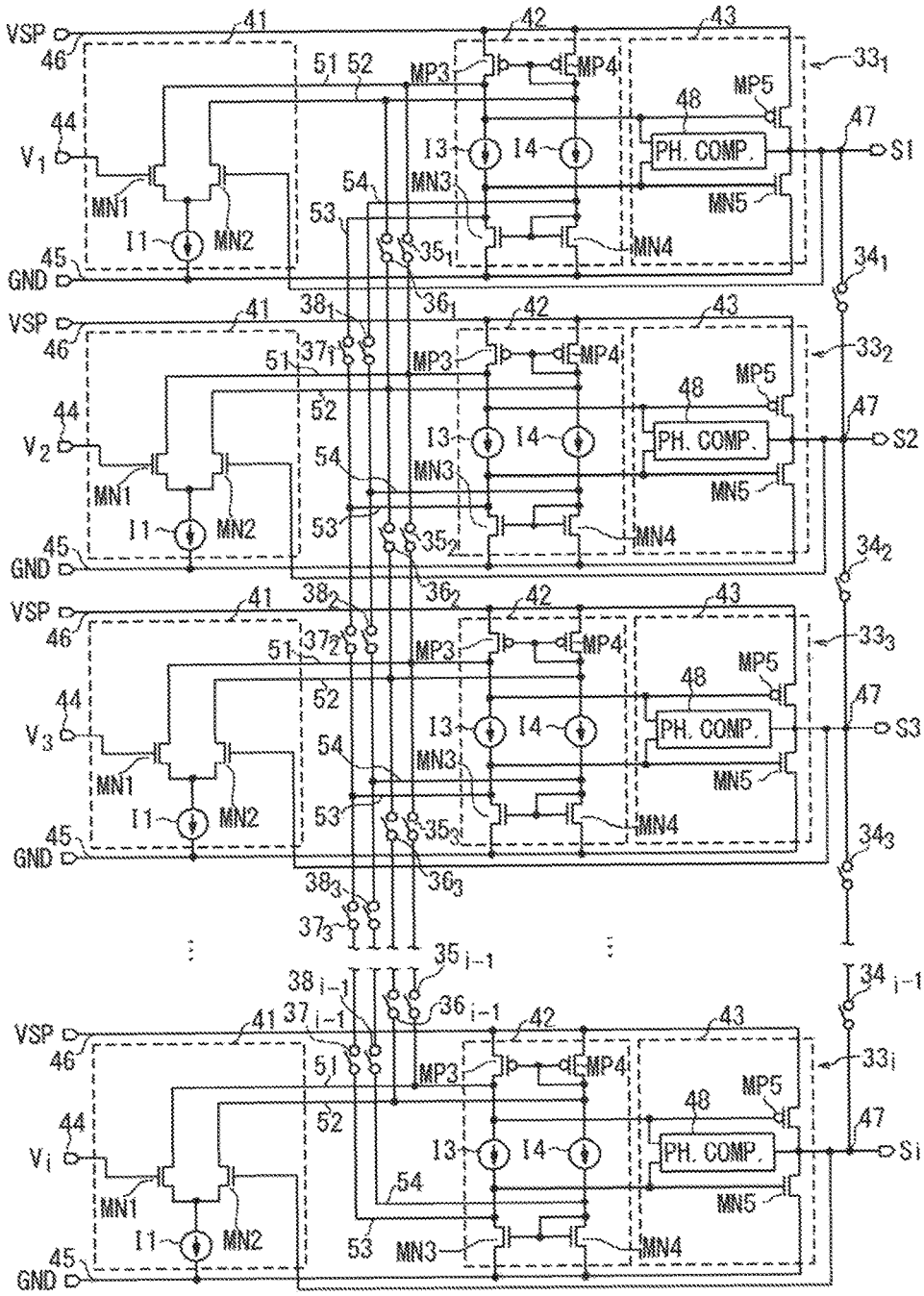
FIG. 5C is a circuit diagram illustrating still another example of the configuration of the respective buffer amplifiers and the connections of the connection switches between adjacent buffer amplifiers.

Although FIG. 5A illustrates the configuration in which the differential input circuit 41 includes both of the differential transistor pair of the NMOS transistors MN1 and MN2 and the differential transistor pair of the PMOS transistors MP1 and MP2, the differential input circuit 41 may include only the differential transistor pair of the NMOS transistors MN1 and MN2. FIGS. 5B and 5C are circuit diagrams illustrating exemplary configurations of buffer amplifiers thus configured. In the configuration illustrated in FIG. 5B, the transistor pair of PMOS transistors MP1 and MP2, the constant current source 12 and the drain interconnections 53 and 54 are removed. Additionally, the connection switches 37 and 38, which short-circuit the drain interconnections 53 and 54 between adjacent buffer amplifiers 33, are also removed. In the configuration illustrated in FIG. 5C, on the other hand, the transistor pair of PMOS transistors MP1 and MP2 is removed while the connection switches 37 and 38 remain unremoved. As described above, the connection switches 37 and 38 have the function of electrically connecting the drains of the NMOS transistors MN3 and MN4 of the active load circuits 42 between adjacent buffer amplifiers 33 and therefore the configuration illustrated in FIG. 5C effectively reduces the difference between the source voltages output from adjacent buffer amplifiers 33.

Figure 5D:
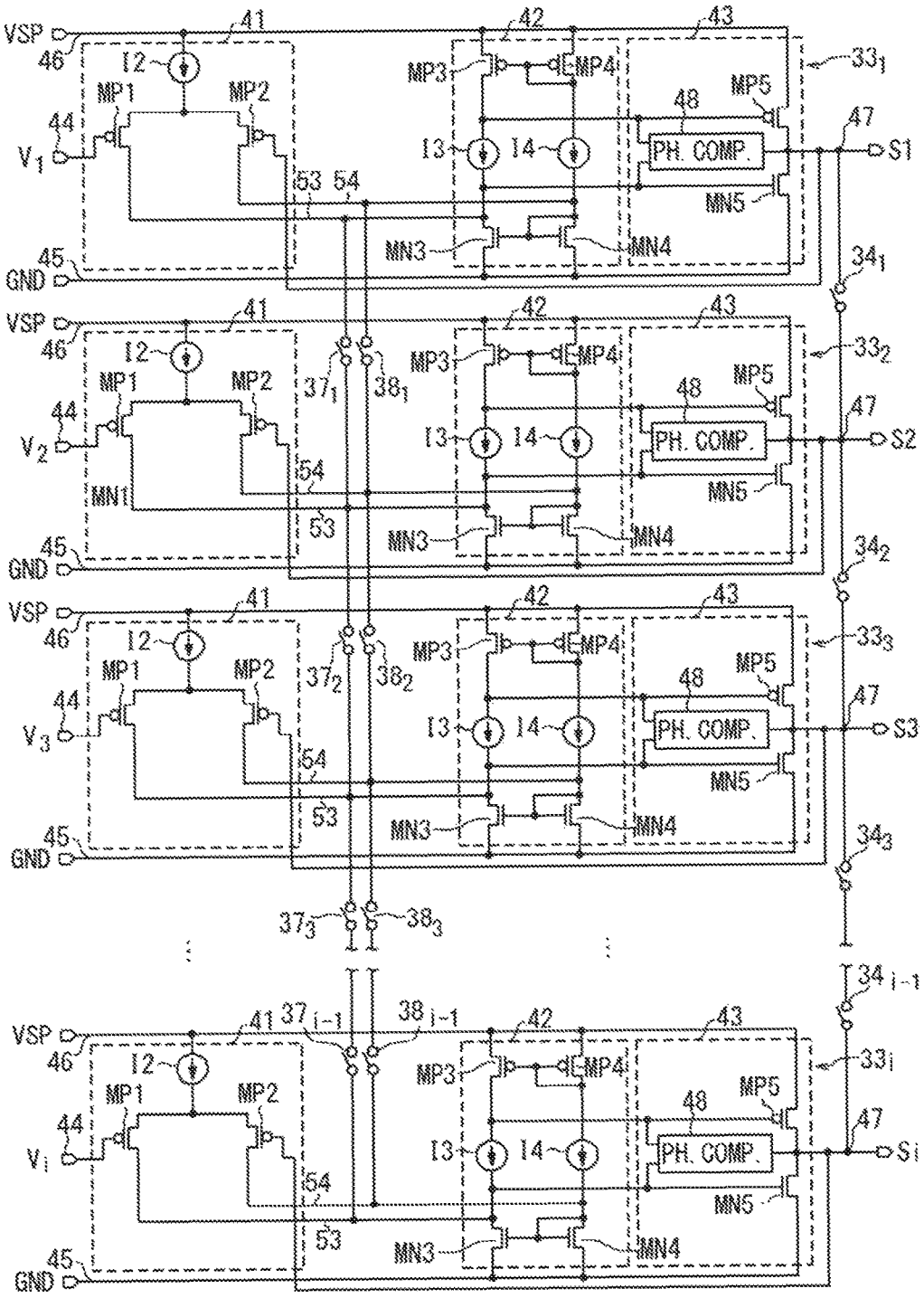
FIG. 5D is a circuit diagram illustrating still another example of the configuration of the respective buffer amplifiers and the connections of the connection switches between adjacent buffer amplifiers.
Figure 5E:
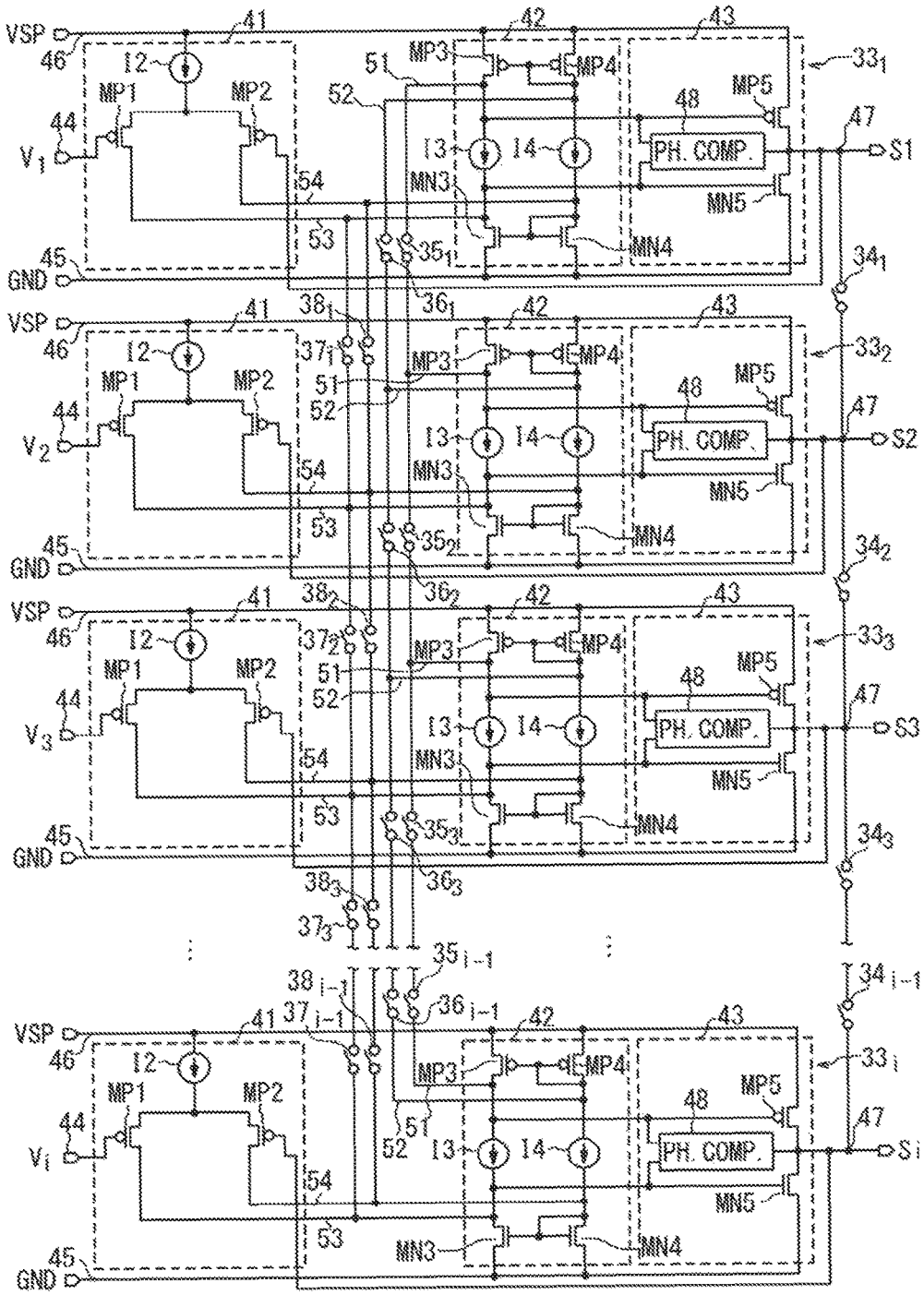
FIG. 5E is a circuit diagram illustrating still another example of the configuration of the respective buffer amplifiers and the connections of the connection switches between adjacent buffer amplifiers.

In an alternative embodiment, the differential input circuit 41 may include only the differential transistor pair of the PMOS transistors MP1 and MP2. FIGS. 5D and 5E are circuit diagrams illustrating exemplary configurations of buffer amplifiers 33 thus configured. In the configuration illustrated in FIG. 5C, the transistor pair of NMOS transistors MN1 and MN2, the constant current source I1 and the drain interconnections 51 and 52 are removed. Additionally, the connection switches 35 and 36, which short-circuit the drain interconnections 51 and 51 between adjacent buffer amplifiers 33, are also removed. In the configuration illustrated in FIG. 5E, on the other hand, the transistor pair of NMOS transistors MN1 and MN2 is removed while the connection switches 35 and 36 remain unremoved. As described above, the connection switches 35 and 36 have the function of electrically connecting the drains of the PMOS transistors MP3 and MP4 of the active load circuits 42 between adjacent buffer amplifiers 33 and therefore the configuration illustrated in FIG. 5E effectively reduces the difference between the source voltages output from adjacent buffer amplifiers 33.

As thus described, the display driver 2 of the present embodiment is configured so that adjacent two buffer amplifiers 33 associated with adjacent two pixels 13 are electrically connected by the connection switches 34 to 38, when the adjacent two pixels 13 are to be driven with the same color, that is, when the image data associated with the adjacent two pixels 13 are same. This allows reducing the difference between the source voltages output from the adjacent two buffer amplifiers 33, even when there is a difference in the offset voltage between the adjacent two buffer amplifiers 33. This operation effectively improves the display image quality of the display device 10.

Figure 7:
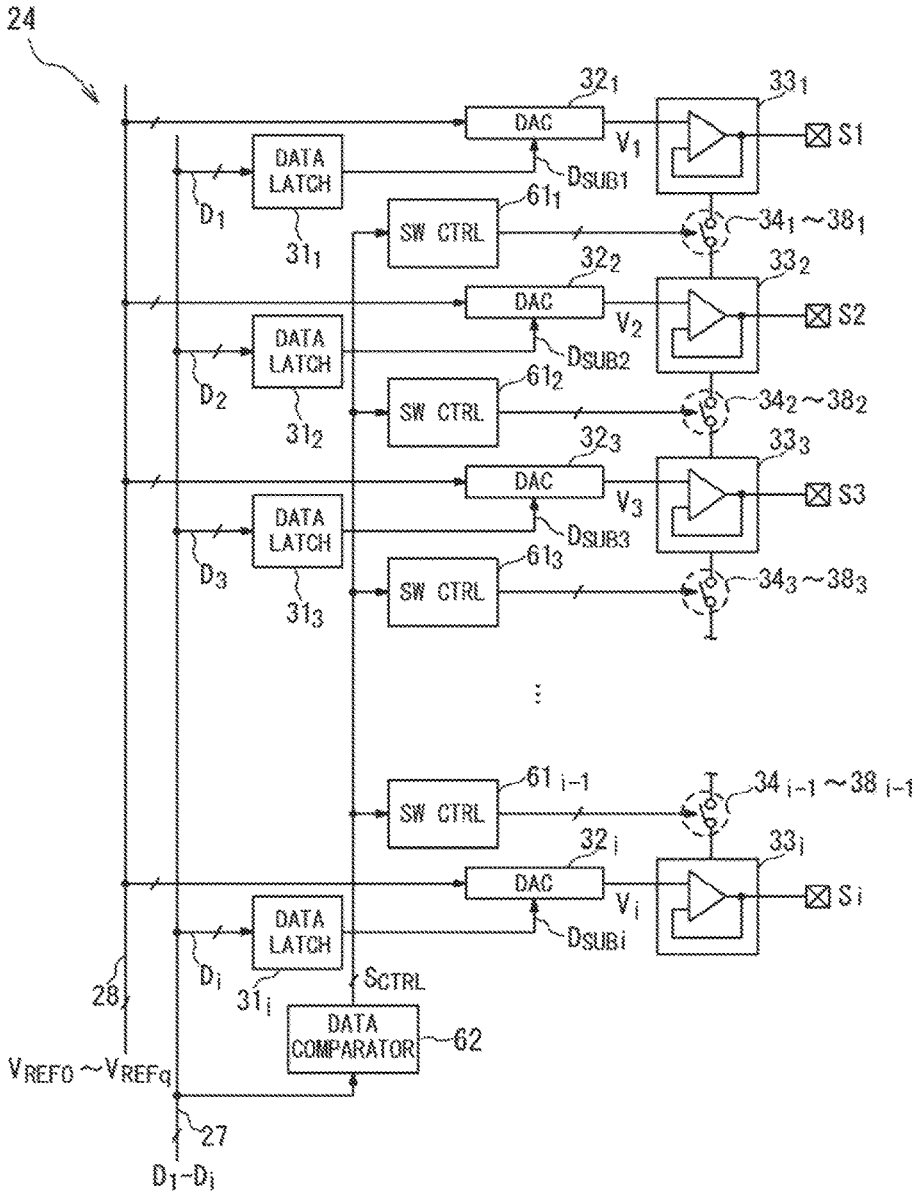
FIG. 7 is a block diagram illustrating a modification of the drive circuitry in the first embodiment.

FIG. 7 is a block diagram illustrating a modification of the drive circuitry 24 in the present embodiment. The configuration of the drive circuitry 24 illustrated in FIG. 7 is similar to that illustrated in FIG. 4; the difference is that the drive circuitry 24 illustrated in FIG. 7 includes switch control circuits 61 and a data comparator 62 in place of the data comparators $\mathbf{39}_1$ to $\mathbf{39}_{m-1}$. It should be noted that the configuration of the buffer amplifiers 33 and the connections of the connection switches 34 to 38 may be selected from those illustrated in FIGS. 5A to 5E.

The switch control circuits 61 are respectively associated with the combinations of adjacent two buffer amplifiers 33 and control the turn-on-and-off of the associated connection switches 34 to 38 in response to the control signals $S_{CTRL}$ received from the data comparator 62. In detail, each switch control circuit $\mathbf{61}_i$ turns on the connection switches $\mathbf{34}_i$ to $\mathbf{38}_i$ connected between the buffer amplifiers $\mathbf{33}_i$ and $\mathbf{33}_{i+1}$ when receiving an instruction to turn on the connection switches $\mathbf{34}_i$ to $\mathbf{38}_i$ over a control signal $S_{CTRL}$ and turns off the connection switches $\mathbf{34}_i$ to $\mathbf{38}_i$ when receiving an instruction to turn off the same.

The data comparator 62 receives image data $D_1$ to $D_m$ associated with pixels 13 of the selected horizontal line, determines which of the connection switches 34 to 38 are to be turned on, on the basis of the image data $D_1$ to $D_m$, and supplies to each of the switch control circuits 61 a control signal $S_{CTRL}$ to indicate whether the corresponding connection switches 34 to 38 are to be turned on, on the basis of the result of the determination.

In detail, in an R drive period, when the R grayscale data of adjacent two pixels 13 of the selected horizontal line are same, the data comparator 62 instructs the relevant switch control circuit 61 to turn on the connection switches 34 to 38 connected between the buffer amplifiers 33 associated with the adjacent two pixels 13. For example, when the R grayscale data $D_{Ri}$ of the image data $D_i$ associated with a pixel 13 corresponding to the source output Si is same as the R grayscale data $D_{R(i+1)}$ of the image data $D_{i+1}$ associated with a pixel 13 corresponding to the source output S(i+1) in an R drive period, the data comparator 62 transmits to the switch control circuit $\mathbf{61}_i$ an instruction to turn on the connection switches $\mathbf{34}_i$ to $\mathbf{38}_i$ over a control signal $S_{CTRL}$. The switch control circuit $\mathbf{61}_i$ turns on the connection switches $\mathbf{34}_{Ri}$ to $\mathbf{38}_i$ in response to the control signal $S_{CTRL}$.

Similarly, in a G drive period, when the G grayscale data of adjacent two pixels 13 of the selected horizontal line are same, the data comparator 62 instructs the relevant switch control circuit 61 to turn on the connection switches 34 to 38 connected between the buffer amplifiers 33 associated with the adjacent two pixels 13. For example, when the G grayscale data $D_{Gi}$ of the image data $D_i$ associated with a pixel 13 corresponding to the source output Si is same as the G grayscale data $D_{G(i+1)}$ of the image data $D_{i+1}$ associated with a pixel 13 corresponding to the source output S(i+1) in a G drive period, the data comparator 62 transmits to the switch control circuit $\mathbf{61}_i$ an instruction to turn on the connection switches $\mathbf{34}_i$ to $\mathbf{38}_i$ over a control signal $S_{CTRL}$. The switch control circuit $\mathbf{61}_i$ turns on the connection switches $\mathbf{34}_i$ to $\mathbf{38}_i$ in response to the control signal $S_{CTRL}$.

Similarly, in a B drive period, when the B grayscale data of adjacent two pixels 13 of the selected horizontal line are same, the data comparator 62 instructs the relevant switch control circuit 61 to turn on the connection switches 34 to 38 connected between the buffer amplifiers 33 associated with the adjacent two pixels 13. For example, when the B grayscale data $D_{Bi}$ of the image data $D_i$ associated with a pixel 13 corresponding to the source output Si is same as the B grayscale data $D_{B(i+1)}$ of the image data $D_{i+1}$ associated with a pixel 13 corresponding to the source output S(i+1) in a B drive period, the data comparator 62 transmits to the switch control circuit $\mathbf{61}_i$ an instruction to turn on the connection switches $\mathbf{34}_i$ to $\mathbf{38}_i$ over a control signal $S_{CTRL}$. The switch control circuit $\mathbf{61}_i$ turns on the connection switches $\mathbf{34}_i$ to $\mathbf{38}_i$ in response to the control signal $S_{CTRL}$.

The operation of the display driver 2 including the drive circuitry 24 configured as illustrated in FIG. 7 is same as that of the display driver 2 including the drive circuitry 24 configured as illustrated in FIG. 4, except for that the data comparator 62 determines whether the R grayscale data, G grayscale data, and B grayscale data are same for each combination of adjacent two pixels 13 of the selected horizontal line.

Also in the display driver 2 including the drive circuitry 24 illustrated in FIG. 7, adjacent two buffer amplifiers 33 associated with adjacent two pixels 13 are connected by the corresponding connection switches 34 to 38 in an R drive period when the grayscale levels of the R subpixels 16R indicated in the image data associated with the adjacent two pixels 13 are equal to each other (that is, when the R grayscale data are same.) Similarly, adjacent two buffer amplifiers 33 associated with adjacent two pixels 13 are connected by the corresponding connection switches 34 to 38 in a G drive period, when the grayscale levels of the G subpixels 16G indicated in the image data associated with the adjacent two pixels 13 are equal to each other (that is, when the G grayscale data are same.) Furthermore, adjacent two buffer amplifiers 33 associated with adjacent two pixels 13 are connected by the corresponding connection switches 34 to 38 in a B drive period, when the grayscale levels of the B subpixels 16B indicated in the image data associated with the adjacent two pixels 13 are equal to each other (that is, when the B grayscale data are same). This effectively reduces the difference between the source voltages output from the adjacent two buffer amplifiers 33 even when there is a difference in the offset voltage between the adjacent two buffer amplifiers 33

Second Embodiment

Figure 8:
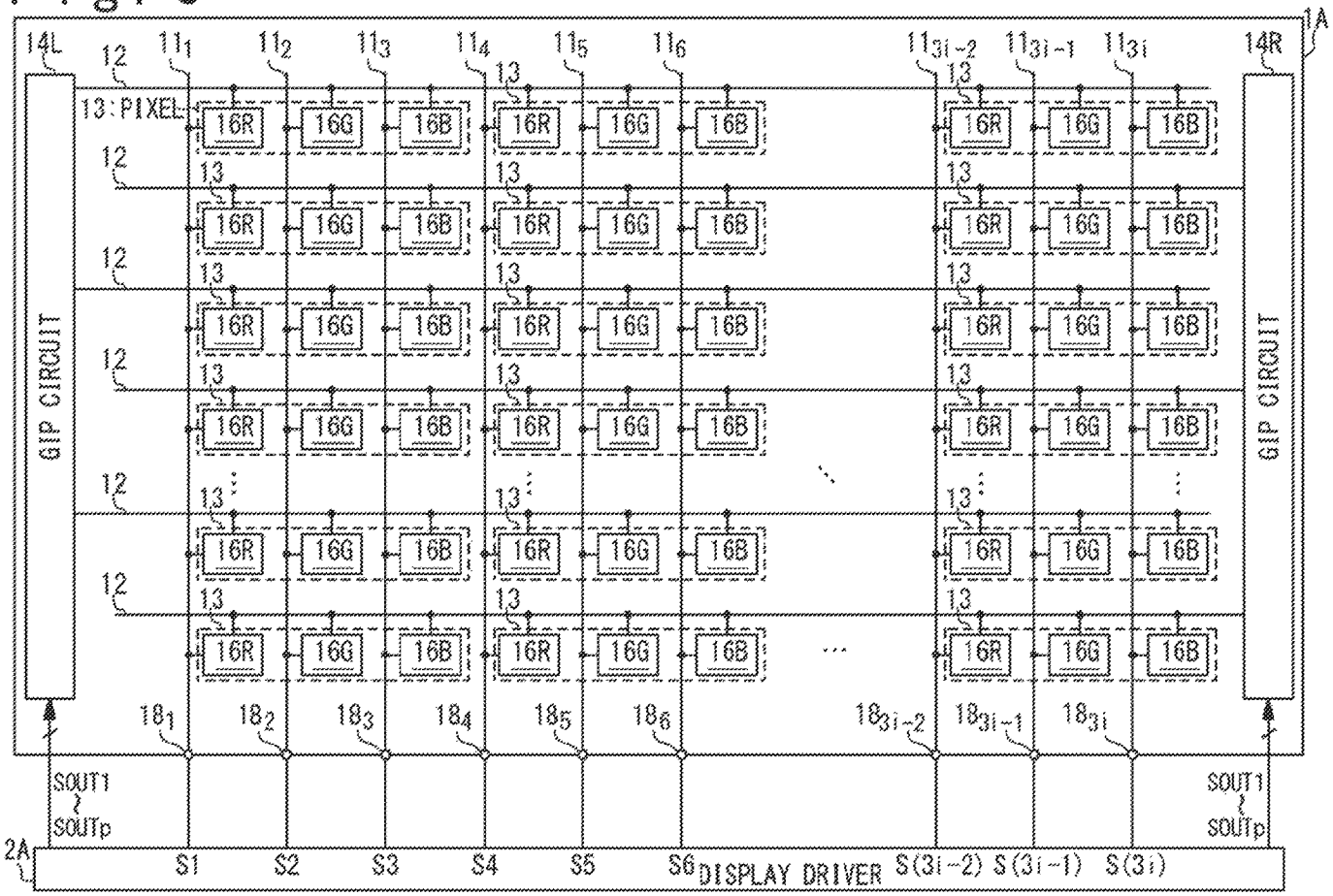
FIG. 8 is a diagram schematically illustrating an exemplary configuration of a display panel in a second embodiment.

FIG. 8 is a diagram schematically illustrating an exemplary configuration of a display device 10, especially an exemplary configuration of a display panel 1A in a second embodiment. In the second embodiment, the time-divisional driving scheme is not used to drive the display panel 1A. The display panel 1A is adapted to an operation in which the R subpixel 16R, G subpixel 16G and B subpixel 16B of each pixel 13 of a selected horizontal line are driven at the same time in the display period of each horizontal sync period.

In detail, the configuration of the display panel 1A illustrated in FIG. 8 is similar to that of the display panel 1 illustrated in FIG. 2; the different is that the display panel 1A illustrated in FIG. 8 does not include the switch circuits 15. In the display panel 1A illustrated in FIG. 8, 3m source lines $\mathbf{11}_1$ to $\mathbf{11}_{3m}$ are connected to the panel terminals $\mathbf{18}_1$ to $\mathbf{18}_{3m}$, respectively. The panel terminals $\mathbf{18}_1$ to $\mathbf{18}_{3m}$ are connected to the source outputs S1 to S(3m) of the display driver 2A. It should be noted that the (3i−2)-th source line $\mathbf{11}_{3i-2}$ is connected to a column of R subpixels 16R for i being an integer from 1 to m in the display panel 1A illustrated in FIG. 8, similarly to the display panel 1 illustrated in FIG. 2. Correspondingly, the (3i−1)-th source line $\mathbf{11}_{3i-1}$ is connected to a column of G subpixels 16G and the (3i)-th source line $\mathbf{11}_{3i}$ is connected to a column of B subpixels 16B.

Figure 9:
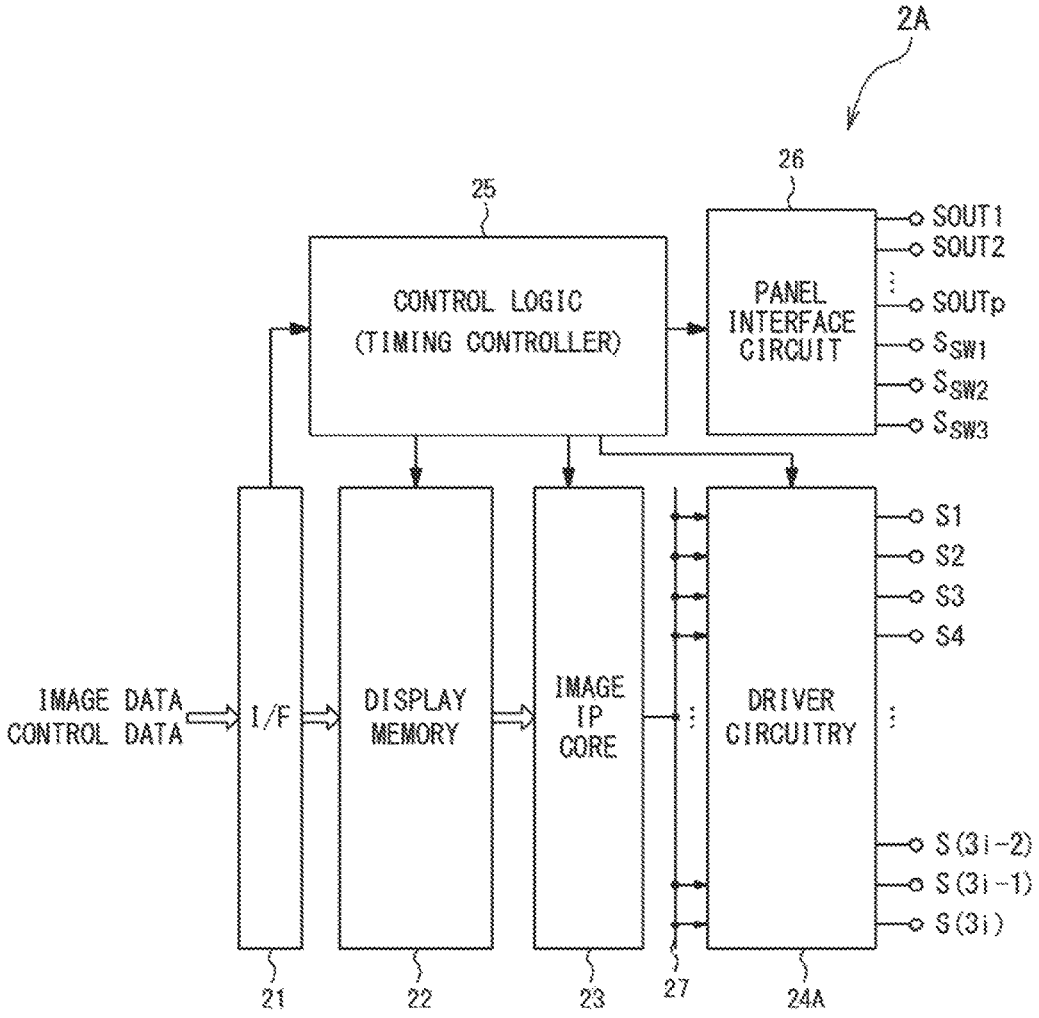
FIG. 9 is a block diagram illustrating an exemplary configuration of a display driver in the second embodiment.

FIG. 9 is a block diagram illustrating an exemplary configuration of the display driver 2A in the second embodiment. Although the configuration of the display driver 2A in the second embodiment is similar to that of the display driver 2 in the first embodiment, the configuration of the drive circuitry 24A of the display driver 2A in the second embodiment is different from that of the display driver 2 in the first embodiment. In the second embodiment, the drive circuitry 24A is configured to drive the source outputs S1 to S(3m), that is, drive the 3m source lines $\mathbf{11}_1$ to $\mathbf{11}_{3m}$.

In the second embodiment, the source voltages to be supplied to the R subpixel 16R, the G subpixel 16G and the B subpixel 16B of each pixel 13 are output from the three corresponding source outputs. For example, with respect to a pixel 13 having an R subpixel 16R, a G subpixel 16G and a B subpixel 16B connected to the source lines $\mathbf{11}_{3i-2}$, $\mathbf{11}_{3i-1}$ and $\mathbf{11}_{3i}$, respectively, the source voltages to be supplied to the R subpixel 16R, the G subpixel 16G and the B subpixel 16B of the pixel 13 are output from the source outputs S(3i−2), S(3i−1) and S(3i).

Figure 10:
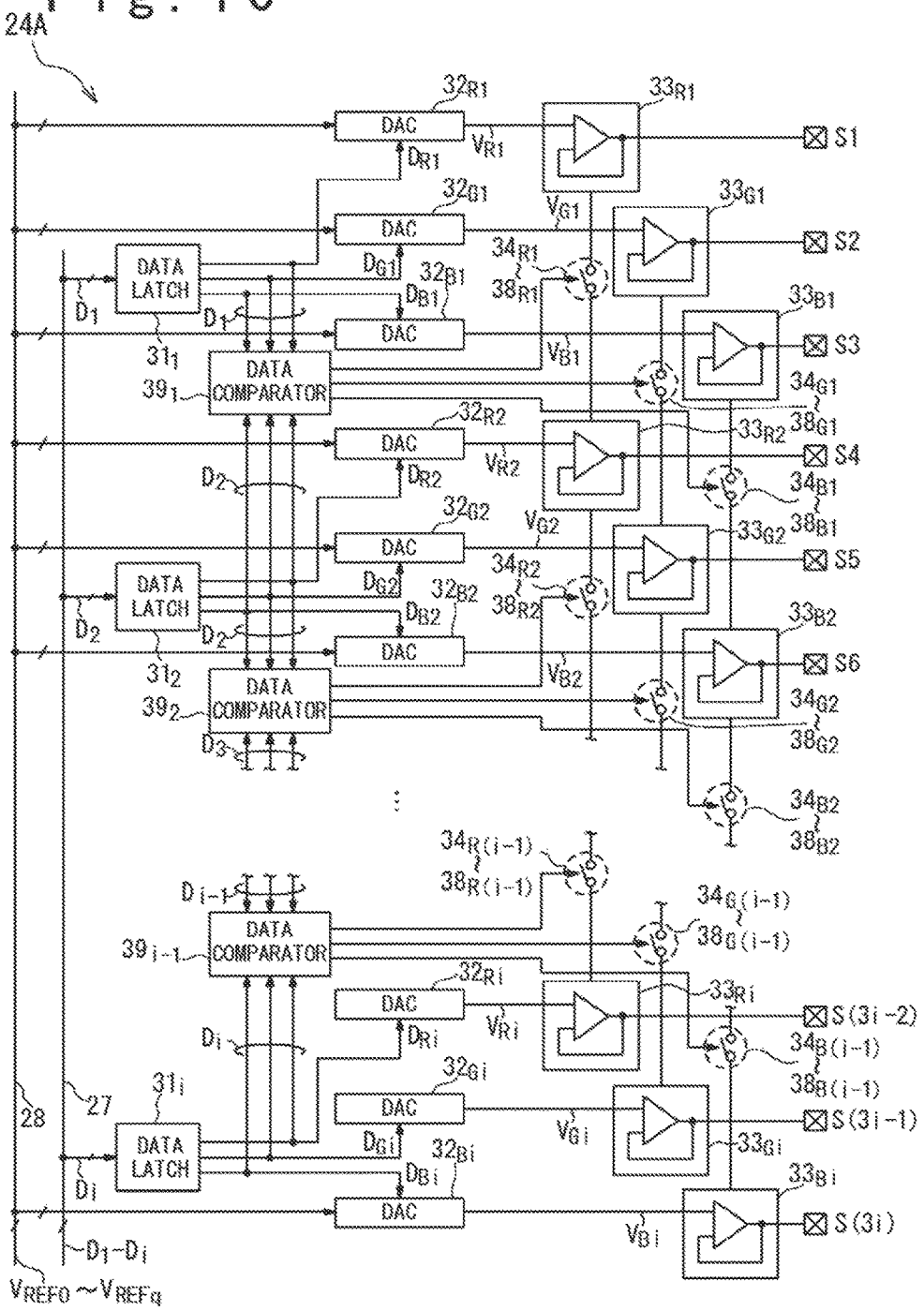
FIG. 10 is a block diagram illustrating an exemplary configuration of a drive circuitry in the second embodiment.

FIG. 10 is a block diagram illustrating an exemplary configuration of the drive circuitry 24A in the second embodiment. The drive circuitry 24A includes data latches $\mathbf{31}_1$ to $\mathbf{31}_m$, DACs $\mathbf{32}_{R1}$ to $\mathbf{32}_{Rm}$, $\mathbf{32}_{G1}$ to $\mathbf{32}_{Gm}$, $\mathbf{32}_{B1}$ to $\mathbf{32}_{Bm}$ and buffer amplifiers $\mathbf{33}_{R1}$ to $\mathbf{33}_{Rm}$, $\mathbf{33}_{G1}$ to $\mathbf{32}_{Gm}$ and $\mathbf{33}_{B1}$ to $\mathbf{33}_{Bm}$. In the present embodiment, one data latch 31 is associated with every three source outputs and one DAC 32 and one buffer amplifier 33 are associated with every source output.

Each data latch 31 receives image data of a pixel 13 associated with the three corresponding source outputs from the data bus 27 and stores therein the received image data. In detail, the data latch $\mathbf{31}_i$ are associated with the three source outputs S(3i−2), S(3i−1) and S(3i) and stores therein the image data $D_i$ of a pixel 13 associated with the source outputs S(3i−2), S(3i−1) and S(3i). The image data $D_i$ of a certain pixel 13 includes an R grayscale data $D_{Ri}$, G grayscale data $D_{Gi}$ and B grayscale data $D_{Bi}$ which indicate the grayscale levels of the R subpixel 16R, G subpixel 16G and B subpixel 16B of the specific pixel 13, respectively. In a certain horizontal sync period, image data of the pixels 13 of the horizontal line selected in the horizontal sync period are stored in the data latches 31.

The DACs $\mathbf{32}_{R1}$ to $\mathbf{32}_{Rm}$ and the buffer amplifiers $\mathbf{33}_{R1}$ to $\mathbf{33}_{Rm}$ are used to drive the source lines 11 connected to the R subpixels 16R (that is, the source lines 11 connected to the source outputs S1, S4, S7, . . . , S(3i−2), . . . , S(3m−2)). More specifically, each DAC $\mathbf{32}_{Ri}$ receives the R grayscale data $D_{Ri}$ of the image data $D_i$ of a pixel 13 corresponding to the source output S(3i−2) from the data latch $\mathbf{31}_i$. The DAC $\mathbf{32}_{Ri}$ generates a grayscale voltage $V_{Ri}$ by performing digital-analog conversion on the received R grayscale data $D_{Ri}$ by using the reference voltages $V_{REF0}$ to $V_{REFq}$ received from the reference voltage bus 28. The DAC $\mathbf{32}_{Ri}$ outputs the grayscale voltage $V_{Ri}$ thus generated to the corresponding buffer amplifier $\mathbf{33}_{Ri}$. Each buffer amplifier $\mathbf{33}_{Ri}$ is configured to receive the grayscale voltage $V_{Ri}$ and output to the source output S(3i−2) a source voltage having the same voltage level as the grayscale voltage $V_{Ri}$.

Similarly, the DACs $\mathbf{32}_{G1}$ to $\mathbf{32}_{Gm}$ and the buffer amplifiers $\mathbf{33}_{G1}$ to $\mathbf{33}_{Gm}$ are used to drive the source lines 11 connected to the G subpixels 16G (that is, the source lines 11 connected to the source outputs S2, S5, S8, . . . , S(3i−1), . . . , S(3m−1)). More specifically, each DAC $\mathbf{32}_{Gi}$ receives the G grayscale data $D_{Gi}$ of the image data $D_i$ of a pixel 13 corresponding to the source output S(3i−1) from the data latch $\mathbf{31}_i$. The DAC $\mathbf{32}_{Gi}$ generates a grayscale voltage $V_{Gi}$ by performing digital-analog conversion on the received G grayscale data $D_{Gi}$ by using the reference voltages $V_{REF0}$ to $V_{REFq}$ received from the reference voltage bus 28. The DAC $\mathbf{32}_{Gi}$ outputs the grayscale voltage $V_{Gi}$ thus generated to the corresponding buffer amplifier $\mathbf{33}_{Gi}$. Each buffer amplifier $\mathbf{33}_{Gi}$ is configured to receive the grayscale voltage $V_{Gi}$ and output to the source output S(3i−1) a source voltage having the same voltage level as the grayscale voltage $V_{Gi}$.

Furthermore, the DACs $\mathbf{32}_{B1}$ to $\mathbf{32}_{Bm}$ and the buffer amplifiers $\mathbf{33}_{B1}$ to $\mathbf{33}_{Bm}$ are used to drive the source lines 11 connected to the B subpixels 16B (that is, the source lines 11 connected to the source outputs S3, S6, S9, . . . , S(3i), . . . , S(3m)). More specifically, each DAC $\mathbf{32}_{Bi}$ receives the B grayscale data $D_{Bi}$ of the image data $D_i$ of a pixel 13 corresponding to the source output S(3i) from the data latch $\mathbf{31}_i$. The DAC $\mathbf{32}_{Bi}$ generates a grayscale voltage $V_{Bi}$ by performing digital-analog conversion on the received B grayscale data $D_{Bi}$ by using the reference voltages $V_{REF0}$ to $V_{REFq}$ received from the reference voltage bus 28. The DAC $\mathbf{32}_{Bi}$ outputs the grayscale voltage $V_{Bi}$ thus generated to the corresponding buffer amplifier $\mathbf{33}_{Bi}$. Each buffer amplifier $\mathbf{33}_{Bi}$ is configured to receive the grayscale voltage $V_{Bi}$ and output to the source output S(3i) a source voltage having the same voltage level as the grayscale voltage $V_{Bi}$.

To address the problem of the display image quality deterioration potentially caused by the offset voltages of the buffer amplifiers 33, the drive circuitry 24A includes connection switches $\mathbf{34}_R$ to $\mathbf{38}_R$, $\mathbf{34}_G$ to $\mathbf{38}_G$, $\mathbf{34}_3$ to $\mathbf{38}_3$ and data comparators 39 in the present embodiment.

The connection switches $\mathbf{34}_{Ri}$ to $\mathbf{38}_{Ri}$ are configured to electrically connect the output nodes and internal nodes of the buffer amplifiers $\mathbf{33}_{Ri}$ and $\mathbf{33}_{R(i+1)}$. Although five connection switches $\mathbf{34}_{Ri}$ to $\mathbf{38}_{Ri}$ are connected between the buffer amplifiers $\mathbf{33}_{Ri}$ and $\mathbf{33}_{R(i+1)}$ in the present embodiment as described later (also see FIG. 11), only one switch symbol is illustrated to collectively denote the connection switches $\mathbf{34}_{Ri}$ to $\mathbf{38}_{Ri}$ in FIG. 10.

The connection switches $34_{Gi}$ to $38_{Gi}$ are configured to electrically connect the output nodes and internal nodes of the buffer amplifiers $33_{Gi}$ and $33_{G(i+1)}$. Although five connection switches $34_{Gi}$ to $38_{Gi}$ are connected between the buffer amplifiers $33_{Gi}$ and $33_{G(i+1)}$ in the present embodiment, only one switch symbol is illustrated to collectively denote the connection switches $34_{Gi}$ to $38_{Gi}$ in FIG. 10.

The connection switches $34_{Bi}$ to $38_{Bi}$ are configured to electrically connect the output nodes and internal nodes of the buffer amplifiers $33_{Bi}$ and $33_{B(i+1)}$. Although five connection switches $34_{Bi}$ to $38_{Bi}$ are connected between the buffer amplifiers $33_{Bi}$ and $33_{B(i+1)}$ in the present embodiment, only one switch symbol is illustrated to collectively denote the connection switches $34_{Bi}$ to $38_{Bi}$ in FIG. 10.

It should be noted that the connection switches $34_R$ to $38_R$, $34_G$ to $38_G$, $34_B$ to $38_B$ are arranged as a whole to electrically connect buffer amplifiers $33_R$, $33_G$ and $33_B$ connected to three every other source lines 11. The source lines 11 driven by the buffer amplifiers $33_{R1}$ to $33_{Rm}$, that is, the source lines 11 connected to R subpixels 11R are three every other ones of the 3m source lines 11 of the display panel 1A. Similarly, the source lines 11 driven by the buffer amplifiers $33_{G1}$ to $33_{Gm}$, that is, the source lines 11 connected to G subpixels 11G are other three every other ones of the 3m source lines 11 of the display panel 1A and the source lines 11 driven by the buffer amplifiers $33_{B1}$ to $33_{Bm}$, that is, the source lines 11 connected to B subpixels 11B are still other three every other ones of the 3m source lines 11 of the display panel 1A.

The data comparators 39 compare image data associated with pixels 13 adjacent each other in the horizontal direction to controls turn-on-and-off of the connection switches $34_R$ to $38_R$, $34_G$ to $38_G$ and $34_B$ to $38_B$. More specifically, the data comparator $39_i$ receives image data $D_i$ from the data latch $31_i$ and receives image data $D_{i+1}$ from the data latch $31_{i+1}$. It should be noted that the image data $D_i$ received from the data latch $31_i$ and the image data $D_{i+1}$ received from the data latch $31_{i+1}$ are image data associated with pixels 13 adjacent each other in the horizontal direction. The data comparator $39_i$ compares the received image data $D_i$ and $D_{i+1}$ and controls the turn-on-and-off of the connection switches $34_{Ri}$ to $38_{Ri}$, $34_{Gi}$ to $38_{Gi}$ and $34_{Bi}$ to $38_{Bi}$ on the basis of the comparison result.

In the present embodiment, the data comparator $39_i$ turns on the connection switches $34_{Ri}$ to $38_{Ri}$ when the R grayscale data $D_{Ri}$ of the image data $D_i$ received from the data latch $31_i$ are same as the R grayscale data $D_{R(i+1)}$ of the image data $D_{i+1}$ received from the data latch $31_{i+1}$; otherwise the data comparator $39_i$ turns off the connection switches $34_{Ri}$ to $38_{Ri}$. Also, the data comparator $39_i$ turns on the connection switches $34_{Gi}$ to $38_{Gi}$ when the G grayscale data $D_{Gi}$ of the image data $D_i$ received from the data latch $31_i$ are same as the G grayscale data $D_{G(i+1)}$ of the image data $D_{i+1}$ received from the data latch $31_{i+1}$; otherwise the data comparator $39_i$ turns off the connection switches $34_{Gi}$ to $38_{Gi}$. Similarly, the data comparator $39_i$ turns on the connection switches $34_{Bi}$ to $38_{Bi}$ when the B grayscale data $D_{Bi}$ of the image data $D_i$ received from the data latch $31_i$ are same as the B grayscale data $D_{B(i+1)}$ of the image data $D_{i+1}$ received from the data latch $31_{i+1}$; otherwise the data comparator $39_i$ turns off the connection switches $34_{Bi}$ to $38_{Bi}$.

In this operation, two buffer amplifiers $33_R$ associated with the R subpixels 16R of two pixels 13 adjacent in the horizontal direction are electrically connected when the grayscale levels of the R subpixels 16R indicated in the image data associated with the two pixels 13 are equal to each other, and this effectively eliminates the difference in the offset voltage between the two buffer amplifiers $33_R$. The similar goes for the G subpixels 16G and the B subpixels 16B. Two buffer amplifiers $33_G$ associated with the G subpixels 16G of two pixels 13 adjacent in the horizontal direction are electrically connected when the grayscale levels of the G subpixels 16G indicated in the image data associated with the two pixels 13 are equal to each other, and this effectively eliminates the difference in the offset voltage between the two buffer amplifiers $33_G$. Two buffer amplifiers $33_B$ associated with the B subpixels 16B of two pixels 13 adjacent in the horizontal direction are electrically connected when the grayscale levels of the B subpixels 16B indicated in the image data associated with the two pixels 13 are equal to each other, and this effectively eliminates the difference in the offset voltage between the two buffer amplifiers $33_3$.

Figure 11:
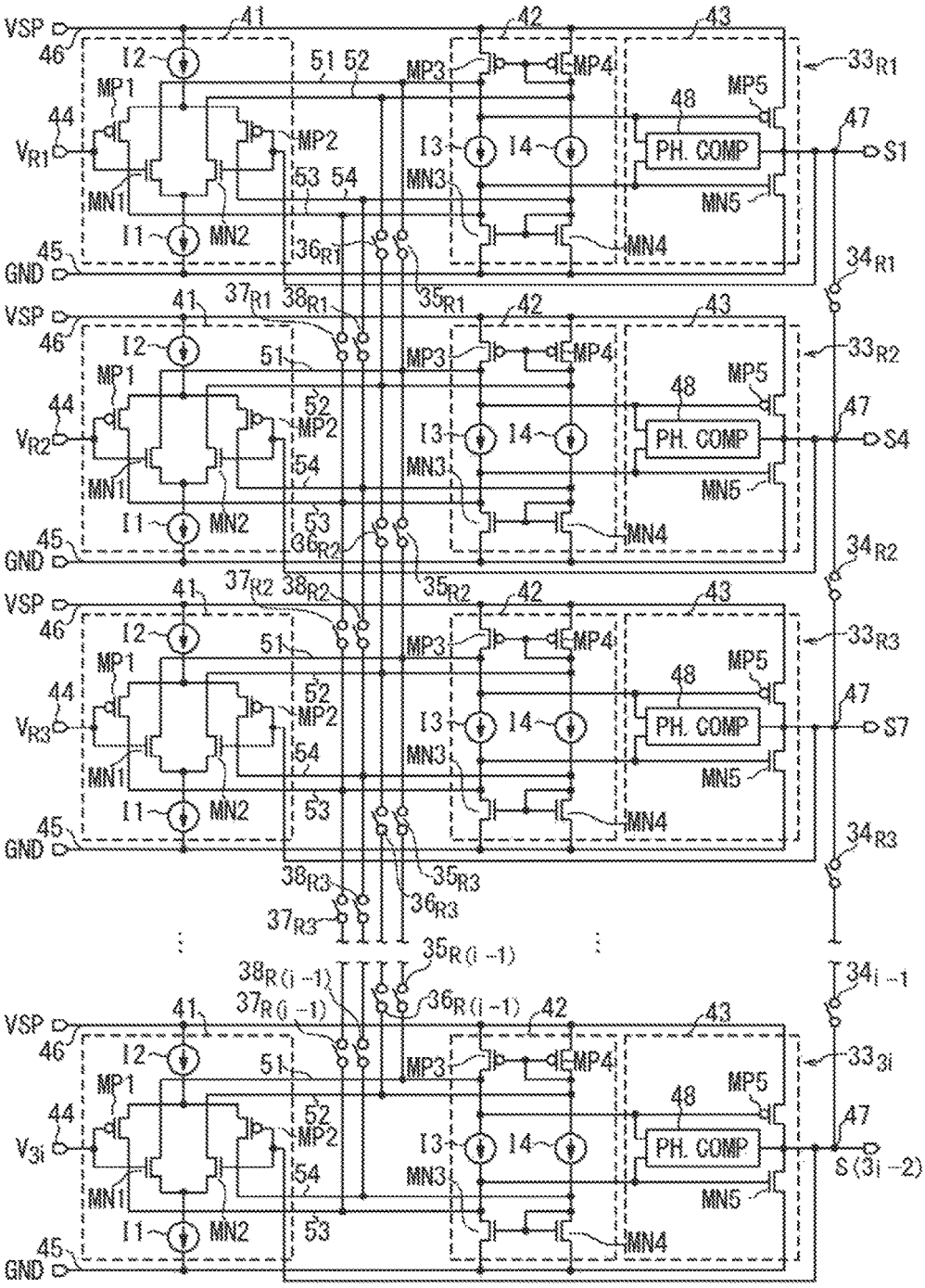
FIG. 11 is a circuit diagram illustrating one example of the configuration of the respective buffer amplifiers and the connections of the connection switches between adjacent buffer amplifiers in the second embodiment.

FIG. 11 is a circuit diagram illustrating the configuration of the buffer amplifiers $33R_1$ to $33R_m$ and the connections of the connection switches $34_R$ to $34_R$ between two of the buffer amplifiers $33R_1$ to $33R_m$. It should be noted that the buffer amplifiers $33_{R1}$ to $33_{Rm}$ drive the source lines 11 connected to R subpixels 16R.

The configuration of the respective buffer amplifiers $33_{Ri}$ in the second embodiment is same as that of the buffer amplifiers $33_i$ in the first embodiment (see FIG. 5A). The buffer amplifier $33_{Ri}$ includes a differential input circuit 41, an active load circuit 42 and an output stage 43 and is configured to output to the source output Si a source voltage having the same voltage level as that of the grayscale voltage $V_{Ri}$ supplied to the input node 44, from the output node 47. The configurations of the differential input circuit 41, the active load circuit 42 and the output stage 43 of the buffer amplifiers $33_{Ri}$ in the second embodiment are same as those of the buffer amplifiers $33_i$ in the first embodiment.

The connection switches $34_R$ to $38_R$ electrically connect closest two of the buffer amplifiers $33R_1$ to $33R_m$ under the control of the data comparators 39. It should be noted that, in the present embodiment, the source lines 11 driven by the buffer amplifiers $33_{R1}$ to $33_{Rm}$, that is, the source lines 11 connected to the R subpixels 16R are three every other ones of the 3m source lines 11 of the display panel 1 and therefore the connection switches $34_R$ to $38_R$ are arranged to connect the buffer amplifiers $33_R$ connected to three every other source lines 11.

In detail, the connection switch $34_{Ri}$ is connected between the output nodes 47 of the buffer amplifiers $33_{Ri}$ and $33_{R(i+1)}$ and used to electrically connect the output nodes 47 of the buffer amplifiers $33_{Ri}$ and $33_{R(i+1)}$ under the control of the data comparator $39_i$.

The connection switch $35_{Ri}$ is connected between the drain interconnections 51 of the buffer amplifiers $33_{Ri}$ and $33_{R(i+1)}$ and used to electrically connect the drain interconnections 51 of the buffer amplifiers $33_{Ri}$ and $33_{R(i+1)}$ under the control of the data comparator $39_i$. The connection switch $36_{Ri}$ is connected between the drain interconnections 52 of the buffer amplifiers $33_{Ri}$ and $33_{R(i+1)}$ and used to electrically connect the drain interconnections 52 of the buffer amplifiers $33_{Ri}$ and $33_{R(i+1)}$ under the control of the data comparator $39_i$.

The connection switch $37_{Ri}$ is connected between the drain interconnections 53 of the buffer amplifiers 3381 and $33_{R(i+1)}$ and used to electrically connect the drain interconnections 53 of the buffer amplifiers $33_{Ri}$ and $33_{R(i+1)}$ under the control of the data comparator $39_i$. The connection switch $38_{Ri}$ is connected between the drain interconnections 54 of the buffer amplifiers $33_{Ri}$ and $33_{R(i+1)}$ and used to electrically connect the drain interconnections 54 of the buffer amplifiers $\mathbf{33}_{Ri}$ and $\mathbf{33}_{R(i+1)}$ under the control of the data comparator $\mathbf{39}_i$.

Although not illustrated, the configuration of the buffer amplifiers $\mathbf{33}_{G1}$ to $\mathbf{33}_{Gm}$ are similar to that of the buffer amplifiers $\mathbf{33}_{R1}$ to $\mathbf{33}_{Rm}$ and the connections of the connection switches $\mathbf{34}_G$ to $\mathbf{38}_G$ between closest two of the buffer amplifiers $\mathbf{33}_{G1}$ to $\mathbf{33}_{Gm}$ are similar to those of the connection switches $\mathbf{34}_R$ to $\mathbf{38}_R$ between closest two of the buffer amplifiers $\mathbf{33}_{R1}$ to $\mathbf{33}_{Rm}$. It should be noted that the connection switches $\mathbf{34}_G$ to $\mathbf{38}_G$ are connected to the buffer amplifiers $\mathbf{33}_G$, which are connected to three every other source lines 11.

Furthermore, the configuration of the buffer amplifiers $\mathbf{33}_{B1}$ to $\mathbf{33}_{Bm}$ are similar to that of the buffer amplifiers $\mathbf{33}_{R1}$ to $\mathbf{33}_{Rm}$ and the connections of the connection switches $\mathbf{34}_B$ to $\mathbf{38}_B$ between closest two of the buffer amplifiers $\mathbf{33}_{B1}$ to $\mathbf{33}_{Bm}$ are similar to those of the connection switches $\mathbf{34}_R$ to $\mathbf{38}_R$ between closest two of the buffer amplifiers $\mathbf{33}_{R1}$ to $\mathbf{33}_{Rm}$. It should be noted that the connection switches $\mathbf{34}_B$ to $\mathbf{38}_B$ are connected to the buffer amplifiers $\mathbf{33}_B$, which are connected to three every other source lines 11.

Figure 12:
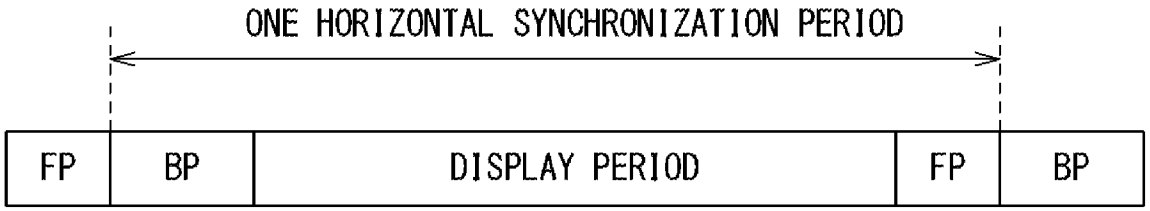
FIG. 12 is a timing chart illustrating an exemplary operation of the display driver in the second embodiment.

Next, a description is given of the operation of the display driver 2A in the present embodiment. FIG. 12 is a timing chart illustrating an exemplary operation of the display driver 2A in the present embodiment.

Also in the display device 10 in the present embodiment, each horizontal sync period includes a back porch period, a display period, and a front porch period. It should be noted however that the time-divisional driving scheme is not used in the present embodiment; the R subpixels 16R, G subpixels 16B and B subpixels 16B of the pixels 13 of the selected horizontal line are driven at the same time in the display period.

In the back porch period, a horizontal line is selected and the gate line 12 corresponding to the selected horizontal line is activated. In parallel, the image data associated with the pixels 13 of the selected horizontal line are written into the data latches 31. More specifically, the image data $D_1$ to $D_m$ associated with the pixels 13 positioned in the selected horizontal line and corresponding to the source outputs S1 to S(3m) are written into the data latches $\mathbf{31}_1$ to $\mathbf{31}_m$, respectively.

In the display period following the back porch period, the R subpixels 16, G subpixels 16G and B subpixels 16B of the pixels 13 of the selected horizontal line are driven.

In detail, each data latch $\mathbf{31}_i$ supplies the R grayscale data $D_{Ri}$ of the image data $D_i$ to the DAC $\mathbf{32}_{Ri}$, the G grayscale data $D_{Gi}$ to the DAC $\mathbf{32}_{Gi}$ and the B grayscale data $D_{Bi}$ to the DAC $\mathbf{32}_{Bi}$.

The DAC $\mathbf{32}_{Ri}$ generates a grayscale voltage $V_{Ri}$ corresponding to the R grayscale data $D_{Ri}$ and supplies the grayscale voltage $V_{Ri}$ to the buffer amplifiers $\mathbf{33}_{Ri}$. Similarly, the DAC $\mathbf{32}_{Gi}$ generates a grayscale voltage $V_{Gi}$ corresponding to the G grayscale data $D_{Gi}$ and supplies the grayscale voltage $V_{Gi}$ to the buffer amplifiers $\mathbf{33}_{Gi}$, and the DAC $\mathbf{32}_{Bi}$ generates a grayscale voltage $V_{Bi}$ corresponding to the B grayscale data $D_{Bi}$ and supplies the grayscale voltage $V_{Bi}$ to the buffer amplifiers $\mathbf{33}_{Bi}$.

The buffer amplifier $\mathbf{33}_{Ri}$ outputs a source voltage having the same voltage level as the grayscale voltage $V_{Ri}$ to the source output S(3i−2). Similarly, the buffer amplifier $\mathbf{33}_{Gi}$ outputs a source voltage having the same voltage level as the grayscale voltage $V_{Gi}$ to the source output S(3i−1) and the buffer amplifier $\mathbf{33}_{Bi}$ outputs a source voltage having the same voltage level as the grayscale voltage $V_{Bi}$ to the source output S(3i). This operation allows supplying the source voltages generated on the source outputs S(3i−2), S(3i−1) and S(3i) to the R subpixels 16R, G subpixels 16G and B subpixels 16B of the associated pixels 13 of the selected horizontal line.

In parallel, in the display period, the image data of adjacent pixels 13 of the selected horizontal line are compared by the data comparators 39 and the connection switches $\mathbf{34}_R$ to $\mathbf{38}_R$, $\mathbf{34}_G$ to $\mathbf{38}_G$ and $\mathbf{34}_B$ to $\mathbf{38}_B$ are turned on or off in response to the comparison result. More specifically, each data comparator $\mathbf{39}_i$ turns on the connection switches $\mathbf{34}_{Ri}$ to $\mathbf{38}_{Ri}$ when the R grayscale data $D_{Ri}$ and $D_{R(i+1)}$ of the image data $D_i$ and $D_{i+1}$ are same.

This operation allows electrically connecting the buffer amplifiers $\mathbf{33}_R$ associated with two pixels 13 adjacent in the horizontal direction, when the grayscale levels of the R subpixels 16R indicated by the image data associated with the adjacent two pixels 13 are equal to each other. This allows making the source voltages supplied to the R subpixels 16R of the adjacent two pixels 13 equal to each other. This operation effectively addresses the problem of the difference in the offset voltage between the buffer amplifiers $\mathbf{33}_R$, making the brightness levels of the R subpixels 16R of the two pixels 13 adjacent in the horizontal direction equal to each other, when the grayscale levels of the R subpixels 16R of the adjacent two pixels 13 indicated in the image data associated with the adjacent two pixels 13 are equal to each other.

When the R grayscale data $D_{Ri}$ and $D_{R(i+1)}$ of the image data $D_i$ and $D_{i+1}$ are different, on the other hand, the data comparator $\mathbf{39}_i$ turns off the connection switches $\mathbf{34}_{Ri}$ to $\mathbf{38}_{Ri}$. In this case, the R subpixels 16R of the adjacent two pixels 13 are driven to have different brightness levels.

The similar goes for the G subpixels 16G and the B subpixels 16B. Each data comparator $\mathbf{39}_i$ turns on the connection switches $\mathbf{34}_{Gi}$ to $\mathbf{38}_{Gi}$ when the G grayscale data $D_{Gi}$ and $D_{G(i+1)}$ of the image data $D_i$ and $D_{i+1}$ are same. This allows making the source voltages supplied to the G subpixels 16G of the adjacent two pixels 13 equal to each other. This operation effectively addresses the problem of the difference in the offset voltage between the buffer amplifiers $\mathbf{33}_G$, making the brightness levels of the G subpixels 16G of the two pixels 13 adjacent in the horizontal direction equal to each other, when the grayscale levels of the G subpixels 16G of the adjacent two pixels 13 indicated in the image data associated with the adjacent two pixels 13 are equal to each other. When the G grayscale data $D_{Gi}$ and $D_{G(i+1)}$ of the image data $D_i$ and $D_{i+1}$ are different, on the other hand, the data comparator $\mathbf{39}_i$ turns off the connection switches $\mathbf{34}_{Gi}$ to $\mathbf{38}_{Gi}$. Similarly, each data comparator $\mathbf{39}_i$ turns on the connection switches $\mathbf{34}_{Bi}$ to $\mathbf{38}_{Bi}$ when the B grayscale data $D_{Bi}$ and $D_{B(i+1)}$ of the image data $D_i$ and $D_{i+1}$ are same. This allows making the source voltages supplied to the B subpixels 16B of the adjacent two pixels 13 equal to each other. This operation effectively addresses the problem of the difference in the offset voltage between the buffer amplifiers $\mathbf{33}_B$, making the brightness levels of the B subpixels 16B of the two pixels 13 adjacent in the horizontal direction equal to each other, when the grayscale levels of the B subpixels 16B of the adjacent two pixels 13 indicated in the image data associated with the adjacent two pixels 13 are equal to each other. When the B grayscale data $D_{Bi}$ and $D_{B(i+1)}$ of the image data $D_i$ and $D_{i+1}$ are different, on the other hand, the data comparator $\mathbf{39}_i$ turns off the connection switches $\mathbf{34}_{Bi}$ to $\mathbf{38}_{Bi}$.

In the second embodiment, as is the case with the first embodiment, the drive circuitry 24A may include only the connection switches $\mathbf{35}_R$, $\mathbf{35}_G$ and $\mathbf{35}_B$ out of the connection switches $35_R$ to $38_R$, $35_G$ to $38_G$ and $35_B$ to $38_B$, or include only the connection switches $36_R$, $36_G$ and $36_B$ instead. Similarly, the drive circuitry 24A may include only the connection switches $37_R$, $37_G$ and $37_B$ out of the connection switches $35_R$ to $38_R$, $35_G$ to $38_G$ and $35_B$ to $38_B$ or include only the connection switches $38_R$, $38_G$ and $38_B$ instead.

In an alternative embodiment, the drive circuitry 24A may include only the $35_R$, $35_G$, $35_B$, $37_R$, $37_G$ and $37_B$ out of the connection switches $35_R$ to $38_R$, $35_G$ to $38_G$ and $35_B$ to $38_B$.

It should be noted however that the largest effect of reducing the difference between the source voltages output from adjacent two buffer amplifiers $33_R$, $33_G$ and $33_B$ can be achieved when the drive circuitry 24A incorporates all of the connection switches $35_R$ to $38_R$, $35_G$ to $38_G$ and $35_B$ to $38_B$. Accordingly, as illustrated in FIGS. 10 and 11, it is preferable that the drive circuitry 24A includes all of the connection switches $35_R$ to $38_R$, $35_G$ to $38_G$ and $35_B$ to $38_B$.

Although FIG. 11 illustrates the circuit configuration in which the differential input circuits 41 each include both of a differential transistor pair of the NMOS transistors MN1 and MN2 and a differential transistor pair of the PMOS transistors MP1 and MP2, the differential input circuits 41 may each include only the differential transistor pair of the NMOS transistors MN1 and MN2. In this case, the differential transistor pair of the PMOS transistors MP1 and MP2, the constant current source I2 and the drain interconnections 53 and 54 are removed. Additionally, the connection switches $37_R$, $37_G$, $37_B$, $38_R$, $38_G$ and $38_B$, which provide short-circuiting of the drain interconnections 53 and 54 between adjacent two buffer amplifiers $33_R$, $33_G$ and $33_B$, are also removed.

Alternatively, the differential input circuits 41 may each include only the differential transistor pair of the PMOS transistors MP1 and MP2. In this case, the differential transistor pair of the NMOS transistors MN1 and MN2, the constant current source I1 and the drain interconnections 51 and 51 are removed. Additionally, the connection switches $35_R$, $35_G$, $35_B$, $36_R$, $36_G$ and $36_B$, which provide short-circuiting of the drain interconnections 51 and 52 between adjacent two buffer amplifiers $33_R$, $33_G$ and $33_B$, are also removed.

Figure 13:
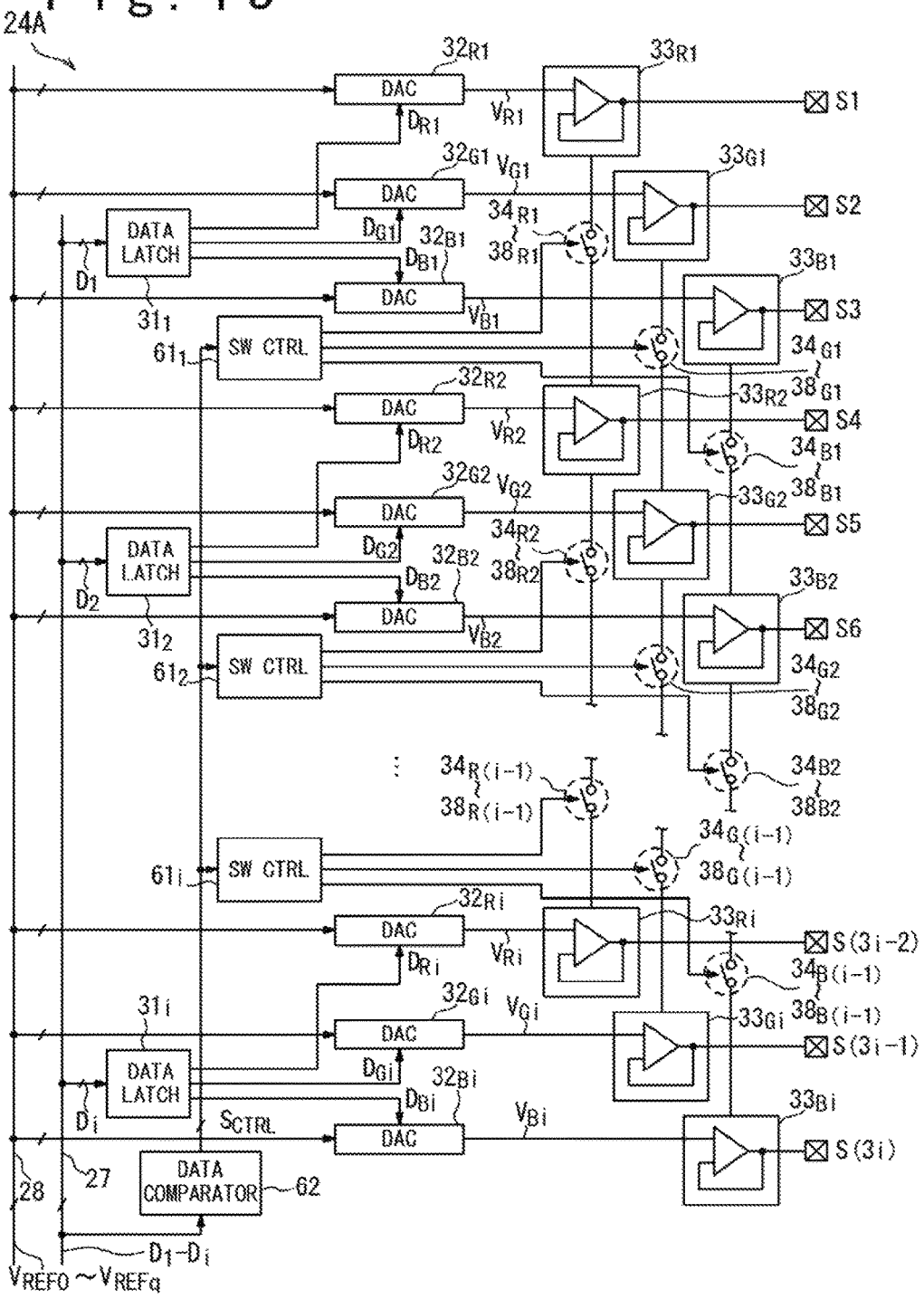
FIG. 13 is a block diagram illustrating a modification of the drive circuitry in the second embodiment.

FIG. 13 is a block diagram illustrating a modification of the drive circuitry 24A of the present embodiment. The configuration of the drive circuitry 24A is similar to that illustrated in FIG. 10; the difference is that switch control circuits $61_1$ to $61_m$ and a data comparator 62 are provided in place of the data comparators $39_1$ to $39_{m-1}$.

The switch control circuits 61 are associated with the respective combinations of two pixels 13 adjacent in the horizontal direction and controls turn-on-and-off of the corresponding connection switches $35_R$ to $38_R$, $35_G$ to $38_G$ and $35_B$ to $38_B$ in response to control signals $S_{CTRL}$ received from the data comparator 62. More specifically, when receiving an instruction to turn on the connection switches $34_{Ri}$ to $38_{Ri}$, $34_{Gi}$ to $38_{Gi}$ and $34_{Bi}$ to $38_{Bi}$ over a control signal $S_{CTRL}$ from the data comparator 62, each switch control circuit $61_i$, turns on the connection switches $34_{Ri}$ to $38_{Ri}$, $34_G$, to $38_G$, and $34_{Bi}$ to $38_{Bi}$. Also, when receiving an instruction to turn off the connection switches $34_{Ri}$ to $38_{Ri}$, $34_{Gi}$ to $38_{Gi}$ and $34_{Bi}$ to $38_{Bi}$ over a control signal $S_{CTRL}$ from the data comparator 62, each switch control circuit $61_i$ turns off the connection switches $34_{Ri}$ to $38_{Ri}$, $34_{Gi}$ to $38_{Gi}$ and $34_{Bi}$ to $38_{Bi}$.

The data comparator 62 receives image data $D_1$ to $D_m$ associated with pixels 13 of the selected horizontal line, determines which of the connection switches $34_R$ to $38_R$, $34_G$ to $38_G$ and $34_B$ to $38_B$ are to be turned on, on the basis of the image data $D_1$ to $D_m$, and supplies to each of the switch control circuits 61 a control signal $S_{CTRL}$ to indicate whether the corresponding connection switches $34_R$ to $38_R$, $34_G$ to $38_G$ and $34_B$ to $38_B$ are to be turned on, on the basis of the result of the determination.

In detail, when the R grayscale data $D_{Ri}$ of the image data $D_i$ and $D_{i+1}$, which are associated with adjacent two pixels 13, are same, the data comparator 62 transmits to the switch control circuit $61_i$ an instruction to turn on the connection switches $34_R$ to $38_R$ over the relevant control signal $S_{CTRL}$. The switch control circuit $61_i$ turns on the connection switches $34_{Ri}$ to $38_{Ri}$ in response to the relevant control signal $S_{CTRL}$. When the G grayscale data $D_{Gi}$ of the image data $D_i$ and $D_{i+1}$ are same, the data comparator 62 transmits to the switch control circuit $61_i$ an instruction to turn on the connection switches $34_G$ to $38_G$ over the relevant control signal $S_{CTRL}$. The switch control circuit $61_i$ turns on the connection switches $34_{Gi}$ to $38_{Gi}$ in response to the relevant control signal $S_{CTRL}$. Furthermore, when the B grayscale data $D_{Bi}$ of the image data $D_i$ and $D_{i+1}$ are same, the data comparator 62 transmits to the switch control circuit $61_i$ an instruction to turn on the connection switches $34_B$ to $38_B$ over the relevant control signal $S_{CTRL}$. The switch control circuit $61_i$ turns on the connection switches $34_{Bi}$ to $38_{Bi}$ in response to the relevant control signal $S_{CTRL}$.

The operation of the display driver 2A including the drive circuitry 24A configured as illustrated in FIG. 13 is almost similar to that of the display driver 2A including the drive circuitry 24A as configured illustrated in FIG. 10, except for that the data comparator 62 determines whether the R grayscale data, G grayscale data and B grayscale data of the image data are same for each of the combinations of the pixels 13 adjacent in the horizontal direction.

Also in the display driver 2A including the drive circuitry 24A configured as illustrated in FIG. 13, two buffer amplifiers $33_R$ associated with two pixels 13 adjacent in the horizontal direction are electrically connected when the grayscale levels of the R subpixels 16R indicated by the image data associated with the adjacent two pixels 13 are equal to each other. This allows making the source voltages supplied to the R subpixels 16R of the adjacent two pixels 13 equal to each other. This operation effectively addresses the problem of the difference in the offset voltage between buffer amplifiers $33_R$, and allows making the brightness levels of the R subpixels 16R of the adjacent two pixels 13 substantially equal to each other when the grayscale levels of the R subpixels 16R of the adjacent two pixels 13 indicated by the image data associated with the adjacent two pixels 13 are equal to each other.

Also, two buffer amplifiers $33_G$ associated with two pixels 13 adjacent in the horizontal direction are electrically connected when the grayscale levels of the G subpixels 16G indicated by the image data associated with the adjacent two pixels 13 are equal to each other. This allows making the source voltages supplied to the G subpixels 16G of the adjacent two pixels 13 equal to each other. This operation effectively addresses the problem of the difference in the offset voltage between buffer amplifiers $33_G$, and allows making the brightness levels of the G subpixels 16G of the adjacent two pixels 13 substantially equal to each other when the grayscale levels of the G subpixels 16G of the adjacent two pixels 13 indicated by the image data associated with the adjacent two pixels 13 are equal to each other.

Furthermore, two buffer amplifiers $33_B$ associated with two pixels 13 adjacent in the horizontal direction are electrically connected when the grayscale levels of the B subpixels 16B indicated by the image data associated with the adjacent two pixels 13 are equal to each other. This allows making the source voltages supplied to the B subpixels 16B of the adjacent two pixels 13 equal to each other. This operation effectively addresses the problem of the difference in the offset voltage between buffer amplifiers $\mathbf{33}_B$, and allows making the brightness levels of the B subpixels 16B of the adjacent two pixels 13 substantially equal to each other when the grayscale levels of the B subpixels 16B of the adjacent two pixels 13 indicated by the image data associated with the adjacent two pixels 13 are equal to each other.

Although various embodiments of the present disclosure have been specifically described in the above, the present invention must not be construed as being limited to the above-described embodiments. A person skilled in the art would appreciate that the present invention may be implemented with various modifications without departing from the scope of the invention.

What is claimed is:

1. A display driver for driving a display panel, comprising:

a first buffer amplifier associated with a first pixel of the display panel;

a second buffer amplifier associated with a second pixel of the display panel, the second pixel being positioned adjacent to a first direction in a horizontal direction;

first and second connection switches; and a controller configured to control the first and second connection switches, wherein each of the first and second buffer amplifiers includes:

a differential input circuit including first and second MISFETs of a first conductivity type, the first and second MISFETs having commonly-connected sources;

a first drain interconnection connected to a drain of the first MISFET;

a second drain interconnection connected to a drain of the second MISFET;

an active load circuit connected to the first and second drain interconnections to operate as an active load of the differential input circuit; and an output stage configured to drive an output node in response to voltages on the first and second drain interconnections, wherein a first grayscale voltage generated in response to image data associated with the first pixel is supplied to a gate of one of the first and second MISFETs of the first buffer amplifier, and a gate of the other of the first and second MISFETs of the first buffer amplifier is connected to the output node of the first buffer amplifier, wherein a second grayscale voltage generated in response to image data associated with the second pixel is supplied to a gate of one of the first and second MISFETs of the second buffer amplifier, and a gate of the other of the first and second MISFETs of the second buffer amplifier is connected to the output node of the second buffer amplifier, wherein the first connection switch is connected between the output nodes of the first and second buffer amplifiers, wherein the second connection switch is connected between the first drain interconnections of the first and second buffer amplifiers, and wherein the controller controls the first and second connection switches in response to the image data associated with the first and second pixels.

2. The display driver according to claim 1, wherein each of the first and second pixels include a first subpixel displaying a first color, and wherein the controller is configured to turn on the first and second connection switches in a period in which the first subpixels of the first and second pixels are driven in a horizontal sync period in which the first and second pixels are selected, when first grayscale data indicating grayscale levels of the first subpixels of the first and second pixels indicated by the image data associated with the first and second pixels are the same.

3. The display driver according to claim 2, wherein each of the first and second pixels further includes:

a second subpixel displaying a second color different than the first color; and a third subpixel displaying a third color different than the first and second colors, wherein the controller is configured to turn on the first and second connection switches in a first period in which the second subpixels of the first and second pixels are driven in the horizontal sync period in which the first and second pixels are selected, when second grayscale data indicating grayscale levels of the second subpixels of the first and second pixels indicated by the image data associated with the first and second pixels are the same, and wherein the controller is configured to turn on the first and second connection switches in a second period in which the third subpixels of the first and second pixels are driven in the horizontal sync period in which the first and second pixels are selected, when third grayscale data indicating grayscale levels of the third subpixels of the first and second pixels indicated by the image data associated with the first and second pixels are the same.

4. The display driver according to claim 1, further comprising:

a third connection switch connected between the second drain interconnections of the first and second buffer amplifiers, and wherein the controller is configured to control the third connection switch in response to the image data associated with the first and second pixels.

5. The display driver according to claim 4, further comprising:

fourth and fifth connection switches, wherein the differential input circuit of each of the first and second buffer amplifiers further includes third and fourth MISFETs of a second conductivity type complementary to the first conductivity type, the third and fourth MISFETs having commonly-connected sources, wherein each of the first and second buffer amplifiers further includes:

a third drain interconnection connected to a drain of the third MISFET; and a fourth drain interconnection connected to a drain of the fourth MISFET, wherein the active load circuit is connected to the third and fourth drain interconnections, wherein the fourth connection switch is connected between the third drain interconnections of the first and second buffer amplifiers, wherein the fifth connection switch is connected between the fourth drain interconnections of the first and second buffer amplifiers, wherein the controller is configured to control the fourth and fifth connection switches in response to the image data associated with the first and second pixels.

6. The display driver according to claim 5, wherein each of the first and second pixels include a first subpixel displaying a first color, and wherein the controller is configured to turn on the first to fifth connection switches in a period in which the first subpixels of the first and second pixels are driven in a horizontal sync period in which the first and second pixels are selected, when first grayscale data indicating grayscale levels of the first subpixels of the first and second pixels indicated by the image data associated with the first and second pixels are the same.

7. The display driver according to claim 1, wherein the display panel is a light emitting diode (LED) display panel.

8. The display driver according to claim 7, wherein the LED display panel is an organic LED (OLED) display panel.

9. A display device, comprising:

a display panel; and a display driver configured to drive the display panel, wherein the display driver includes:

a first buffer amplifier associated with a first pixel of the display panel;

a second buffer amplifier associated with a second pixel of the display panel, the second pixel being positioned adjacent to a first direction in a horizontal direction;

first and second connection switches; and a controller configured to control the first and second connection switches, wherein each of the first and second buffer amplifiers includes:

a differential input circuit including first and second MISFETs of a first conductivity type, the first and second MISFETs having commonly-connected sources;

a first drain interconnection connected to a drain of the first MISFET;

a second drain interconnection connected to a drain of the second MISFET;

an active load circuit connected to the first and second drain interconnections to operate as an active load of the differential input circuit; and an output stage configured to drive an output node in response to voltages on the first and second drain interconnections, wherein a first grayscale voltage generated in response to image data associated with the first pixel is supplied to a gate of one of the first and second MISFET of the first buffer amplifier, and a gate of the other of the first and second MISFET of the first buffer amplifier is connected to the output node of the first buffer amplifier, wherein a second grayscale voltage generated in response to image data associated with the second pixel is supplied to a gate of one of the first and second MISFET of the second buffer amplifier, and a gate of the other of the first and second MISFET of the second buffer amplifier is connected to the output node of the second buffer amplifier, wherein the first connection switch is connected between the output nodes of the first and second buffer amplifiers, wherein the second connection switch is connected between the first drain interconnections of the first and second buffer amplifiers, and wherein the controller controls the first and second connection switches in response to the image data associated with the first and second pixels.

10. The display device according to claim 9, wherein the display driver further includes a third connection switch connected between the second drain interconnections of the first and second buffer amplifiers, and wherein the controller is configured to control the third connection switch in response to the image data associated with the first and second pixels.

11. The display device according to claim 10, wherein the display driver further includes fourth and fifth connection switches, wherein the differential input circuit of each of the first and second buffer amplifiers further includes third and fourth MISFETs of a second conductivity type complementary to the first conductivity type, the third and fourth MISFETs having commonly-connected sources, wherein each of the first and second buffer amplifiers further includes:

a third drain interconnection connected to a drain of the third MISFET; and a fourth drain interconnection connected to a drain of the fourth MISFET, wherein the active load circuit is connected to the third and fourth drain interconnections, wherein the fourth connection switch is connected between the third drain interconnections of the first and second buffer amplifiers, wherein the fifth connection switch is connected between the fourth drain interconnections of the first and second buffer amplifiers, and wherein the controller is configured to control the fourth and fifth connection switches in response to the image data associated with the first and second pixels.

12. The display device according to claim 11, wherein each of the first and second pixels include a first subpixel displaying a first color, and wherein the controller is configured to turn on the first to fifth connection switches in a period in which the first subpixels of the first and second pixels are driven in a horizontal sync period in which the first and second pixels are selected, when first grayscale data indicating grayscale levels of the first subpixels of the first and second pixels indicated by the image data associated with the first and second pixels are the same.

13. The display device according to claim 12, wherein each of the first and second pixels further includes:

a second subpixel displaying a second color different than the first color; and a third subpixel displaying a third color different than the first and second colors, wherein the controller is configured to turn on the first to fifth connection switches in a period in which the second subpixels of the first and second pixels are driven in the horizontal sync period in which the first and second pixels are selected, when second grayscale data indicating grayscale levels of the second subpixels of the first and second pixels indicated by the image data associated with the first and second pixels are the same, and wherein the controller is configured to turn on the first to fifth connection switches in a period in which the third subpixels of the first and second pixels are driven in the horizontal sync period in which the first and second pixels are selected, when third grayscale data indicating grayscale levels of the third subpixels of the first and second pixels indicated by the image data associated with the first and second pixels are the same.

14. The display device according to claim 9, wherein the display panel is a light emitting diode (LED) display panel.

15. The display device according to claim 14, wherein the LED display panel is an organic LED (OLED) display panel.

16. A display driver for driving a display panel, comprising:

a first buffer amplifier associated with a first pixel of the display panel;

a second buffer amplifier associated with a second pixel of the display panel, the second pixel being positioned adjacent to a first direction; and a controller configured to control first and second connection switches, wherein each of the first and second buffer amplifiers includes:

a differential input circuit including first and second transistors of a first conductivity type, the first and second transistors having commonly-connected sources;

a first drain interconnection connected to a drain of the first transistor;

a second drain interconnection connected to a drain of the second transistor;

an active load circuit connected to the first and second drain interconnections to operate as an active load of the differential input circuit; and an output stage configured to drive an output node in response to voltages on the first and second drain interconnections, wherein a first grayscale voltage generated in response to image data associated with the first pixel is supplied to a gate of one of the first and second transistors of the first buffer amplifier, and a gate of the other of the first and second transistors of the first buffer amplifier is connected to the output node of the first buffer amplifier, wherein a second grayscale voltage generated in response to image data associated with the second pixel is supplied to a gate of one of the first and second transistors of the second buffer amplifier, and a gate of the other of the first and second transistors of the second buffer amplifier is connected to the output node of the second buffer amplifier, wherein the first connection switch is connected between the output nodes of the first and second buffer amplifiers, wherein the second connection switch is connected between the first drain interconnections of the first and second buffer amplifiers, and wherein the controller controls the first and second connection switches in response to the image data associated with the first and second pixels.

17. The display driver according to claim 16, wherein each of the first and second pixels include a first subpixel displaying a first color, and wherein the controller is configured to turn on the first and second connection switches in a period in which the first subpixels of the first and second pixels are driven in a horizontal sync period in which the first and second pixels are selected, when first grayscale data indicating grayscale levels of the first subpixels of the first and second pixels indicated by the image data associated with the first and second pixels are the same.

18. The display driver according to claim 17, wherein each of the first and second pixels further includes:

a second subpixel displaying a second color different than the first color; and a third subpixel displaying a third color different than the first and second colors, wherein the controller is configured to turn on the first and second connection switches in a first period in which the second subpixels of the first and second pixels are driven in the horizontal sync period in which the first and second pixels are selected, when second grayscale data indicating grayscale levels of the second subpixels of the first and second pixels indicated by the image data associated with the first and second pixels are the same, and wherein the controller is configured to turn on the first and second connection switches in a second period in which the third subpixels of the first and second pixels are driven in the horizontal sync period in which the first and second pixels are selected, when third grayscale data indicating grayscale levels of the third subpixels of the first and second pixels indicated by the image data associated with the first and second pixels are the same.

19. The display driver according to claim 16, further comprising:

a third connection switch connected between the second drain interconnections of the first and second buffer amplifiers, and wherein the controller is configured to control the third connection switch in response to the image data associated with the first and second pixels.

20. The display driver according to claim 19, further comprising:

fourth and fifth connection switches, wherein the differential input circuit of each of the first and second buffer amplifiers further includes third and fourth transistors of a second conductivity type complementary to the first conductivity type, the third and fourth transistors having commonly-connected sources, wherein each of the first and second buffer amplifiers further includes:

a third drain interconnection connected to a drain of the third transistor; and a fourth drain interconnection connected to a drain of the fourth transistor, wherein the active load circuit is connected to the third and fourth drain interconnections, wherein the fourth connection switch is connected between the third drain interconnections of the first and second buffer amplifiers, wherein the fifth connection switch is connected between the fourth drain interconnections of the first and second buffer amplifiers, wherein the controller is configured to control the fourth and fifth connection switches in response to the image data associated with the first and second pixels.

* * * * *